US006187170B1

(12) United States Patent
Hampp

(10) Patent No.: US 6,187,170 B1
(45) Date of Patent: Feb. 13, 2001

(54) SYSTEM FOR THE ELECTROCHEMICAL DELIGNIFICATION OF LIGNIN-CONTAINING MATERIALS AND A PROCESS FOR ITS APPLICATION

(75) Inventor: Norbert Hampp, Amoneburg (DE)

(73) Assignee: Consortium für elektrochemische Industrie GmbH, Burghausen (DE)

( * ) Notice: Under 35 U.S.C. 154(b), the term of this patent shall be extended for 0 days.

(21) Appl. No.: 09/092,566

(22) Filed: Jun. 5, 1998

(30) Foreign Application Priority Data

Jun. 6, 1997 (DE) ..... 197 23 889

(51) Int. Cl.[7] ..... B27K 5/02

(52) U.S. Cl. ..... 205/688; 205/690; 205/691; 205/742; 204/242

(58) Field of Search ..... 205/688, 690, 205/691, 742; 204/242

(56) References Cited

U.S. PATENT DOCUMENTS

| | | |
|---|---|---|
| Re. 32,825 | 1/1989 | Hull et al. . |
| 4,341,609 | 7/1982 | Eskamani et al. . |
| 4,596,630 | 6/1986 | Hull et al. . |
| 4,617,099 | 10/1986 | Schwab et al. . |
| 4,622,101 | 11/1986 | Hull et al. . |
| 4,786,382 | 11/1988 | Utley et al. . |
| 5,487,881 | 1/1996 | Falgen et al. . |

FOREIGN PATENT DOCUMENTS

| | | |
|---|---|---|
| 2121375 | 10/1995 | (CA) . |
| 2156125 | 2/1996 | (CA) . |
| 19513839 | 10/1996 | (DE) . |
| 0717143 | 6/1996 | (EP) . |
| 9015182 | 12/1990 | (WO) . |
| 9423114 | 10/1994 | (WO) . |
| 9429510 | 12/1994 | (WO) . |
| 9501426 | 1/1995 | (WO) . |

OTHER PUBLICATIONS

Derwent Abstract (#96–477100[47]) corresponding to DE 19513839 No Date Available.

Derwent Abstract (#96–279588 [29]) corresponding to EP 0717143 No Date Available.

Gunic et al., "Electrochemical synthesis of heterocyclic compounds–XX. Anodic synthesis of N–heterocycles with organic mediators." Electrochim. Acta (1990) Abstract only. (No Month).*

* cited by examiner

*Primary Examiner*—Arun S. Phasge
(74) *Attorney, Agent, or Firm*—Collard & Roe, P.C.

(57) ABSTRACT

System for the electrochemical cleavage of compounds which includes a mediator which has no metals or heavy metals and at least two electrodes for the electrochemical activation of the mediator.

15 Claims, No Drawings

SYSTEM FOR THE ELECTROCHEMICAL DELIGNIFICATION OF LIGNIN-CONTAINING MATERIALS AND A PROCESS FOR ITS APPLICATION

BACKGROUND OF THE INVENTION

1. Field of the Invention

The invention relates to a system for the electrochemical delignification of lignin-containing materials and a process for its application.

2. The Prior Art

The term 'lignin-containing materials' summarizes a multiplicity of renewable raw materials, for example wood, grass, and other non-wood-forming plants such as hemp or cotton. This term also includes the intermediate and final products produced therefrom, for example pulp, chemical pulps, paper and textiles. The lignin-containing materials are in general water-insoluble. In these materials, lignin is incorporated into complex structures, for example fibers. Frequently, lignin-containing materials must be delignified, for example when producing high-quality papers. Thus, the lignin present must be wholly or partly depolymerized so that it can be wholly or partly extracted from the lignin-containing materials. This process must depolymerize lignin as selectively as possible, since the substances combined with lignin, such as celluloses and hemicelluloses, are not generally to be destroyed.

In the industrial production of paper, delignification is an essential and necessary process step. The majority of the lignin present in the wood is removed by a primary process step in the current processes for production of chemical pulp. A number of such digestion processes have been developed; the process most frequently used industrially is based on an alkaline boiling of wood with sulfide (Kraft process). After the boiling, the residual lignin content remaining in the resulting pulp must be further reduced. This also applies to other digestion processes, such as the 'ASAM' process or sulfite boiling.

The usual multistage process for removing the residual lignin is termed bleaching. In this process, lignin is removed and/or decolorized. Essentially three different bleaching processes can be differentiated. In what is termed chlorine bleaching, lignin can be removed highly selectively and inexpensively by elemental chlorine. In what is termed ECF bleaching ('elemental chlorine free'), chlorine-free bleaching is achieved using chlorine dioxide. To reduce the chlorine dioxide demand, and thus the environmental pollution, in this process, the ECF bleaching is in part combined with an oxygen delignification. In the third process, what is termed the TCF bleaching ('total chlorine free'), the bleaching is carried out completely in the absence of chlorine-containing compounds. Lignin oxidation is achieved, for example, by a treatment with oxygen and/or ozone and/or peroxide and/or peracids. Chlorine bleaching is now still only employed in old plants. Although technically and economically advantageous, this process must be replaced, since the associated environmental pollution is no longer accepted. In particular, the release of chlorinated aromatic hydrocarbon is an environmental problem. In the ECF process, although the environmental pollution with chlorinated compounds is markedly lower than with chlorine bleaching, chlorinated hydrocarbons are also formed with this process. Furthermore, the $Cl^-$ content makes 'closing the cycle' more difficult. That is operating ECF-bleaching plants with no waste water or a reduced amount of waste water is more difficult. When $Cl^-$ concentrates, plant corrosion can occur. From environmentally-relevant aspects, TCF bleaching is to be preferred to the two processes described. However, it is a problem that the totally chlorine-free bleaching agents, in comparison to chlorine-containing compounds, have a lower selectivity, That is, in addition to lignin depqlymerization, damage to the cellulose and the hemicelluloses also occurs. As a result, there are losses of yield and fiber damage, which can only be minimized by not carrying out the delignification completely. Paper from TCF-bleached chemical pulp has either lower fiber quality or a lower brightness than paper from ECF-bleached chemical pulp. In addition, TCF processes are economically unfavorable, since they require large amounts of relatively expensive process chemicals (e.g. $H_2O_2$, peracetic acid etc.).

In addition to such purely chemical delignification processes, biological catalysts, namely enzymes, are being used for industrial delignification. Such enzymes can attack the lignin either directly or indirectly and thus facilitate the delignification.

Hemicellulases, such as xylanases or mannanases, reinforce the delignification of chemical pulp by an indirect mechanism of action. Wood essentially consists of cellulose, lignin and hemicelluloses. The enzymatic hydrolysis of hemicellulose can facilitate the chemical bleachability of chemical pulp (Chang & Farrell (1995) Proceedings of the 6th International Conference on Biotechnology in the pulp and paper Industry: Advances in Applied and fundamental research, p. 75 ff; Suurnäkki et al. (1995) Proceedings of the 6th International Conference on Biotechnology in the pulp and paper Industry: Advances in Applied and fundamental research, p. 69 ff). As a result of such an enzymatic pretreatment, the requirement of bleaching chemicals can be decreased by a maximum of up to 35% (Chang & Farrel (1995) Proceedings of the 6th International Conference on Biotechnology in the pulp and paper Industry: Advances in Applied and fundamental research, p. 75 ff). However, a disadvantage in this case is particularly that the hydrolysis of the hemicellulose leads to a loss in yield. Furthermore, all of the disadvantages listed below of enzymatic systems also apply to hemicellulases.

In addition, some enzymes exist which are produced by naturally wood-degrading fungi (the so-called white rot fungi) and which can depolymerize lignin with the interaction of what are termed mediators. Enzymes of this type are, for example, lignin peroxidase and manganese peroxidases. These enzymes require $H_2O_2$ for their activity. Since $H_2O_2$ at an excessive dosage also leads to inactivation of the peroxidases, such systems are badly suited to industrial application (Paice et al. (1995) Journal of pulp and paper science. Vol. 21(8) p. 280 ff).

Bourbonnais and Paice (Bourbonnais & Paice (1990) FEBS Letters 267: p. 99 ff) and Call (WO 94/29510) described a system in which a usually lignin-polymerizing enzyme, a laccase, can be used for lignin depolymerization. The process is based on an indirect action of the laccase (Paice et al. (1995) Journal of pulp and paper science. Vol. 21(8) p. 280 ff). In this process, the laccase oxidizes a chemical molecule, what is termed a mediator, producing a free-radical form of the mediator. This mediator free radical is then able to oxidize lignin. In this oxidation the mediator molecule is regenerated. Active mediators are, for example ABTS (Bourbonnais & Paice (1990) FEBS Letters 267: p. 99 ff), HOBT (WO 94/29510) and phenothiazines (WO 95/01426).

The laccase is able to oxidize four mediator molecules, accepting in this process four electrons which ultimately originate from the lignin. Subsequently, in one reaction step, the four electrons are transferred to oxygen and two molecules of water are formed. The system of laccase and mediator thus catalyzes an oxygen-dependent lignin oxidation. The oxidized lignin can subsequently be extracted, for example, by an alkaline treatment (WO 94/29510). In contrast to peroxidases, laccases do not require an addition of $H_2O_2$ and can thus be used industrially.

General problems with the use of enzymes in the chemical pulp industry are the temperature and pH ranges at which the chemical wood digestion processes are carried out. Most chemical bleaching processes are carried out at temperatures above 80° C. and under strongly alkaline conditions at pHs >10.0 or under strongly acidic conditions below pHs of 4.0. However, most enzymes have optima which differ greatly from these values. For economical use of enzyme systems, it is necessary to adapt these systems to appropriate conditions. Thus the thermal stability of at least 80° C., needs to be ensured. Thermostable xylanases, for example, which comply with these requirements, have been isolated from thermophilic microorganisms (Winterhalter et al. (1995) Molecular Microbiology 15: p. 431 ff). However, no laccases or peroxidases have yet been developed which have a sufficiently high thermal stability. The range of application described for the laccase-mediator system is 45° C. and pH 4.5 (WO 94/29510).

In addition, electrochemical processes which are used for paper bleaching are known. In these processes, either chemicals for the conventional bleaching processes are produced in-situ electrochemically and, if appropriate are regenerated. Also, metal complexes are used as mediators which, after activation at an electrode, react with the lignin.

The first group includes, for example, L. N. Spiridonova, V. A. Babkin, M. I. Anisimova, G. S. Mikhailov and T. P. Belovam, 'Delignification of high-yield larchwood pulp by oxidants generated by electrolysis', Khim. Drev. (1982), pp. 16–19. NaCl-electrolysis produces oxidizing species such as $ClO^-$, $ClO_2^-$ and $ClO_3^-$. In addition, J. M. Gray, 'Process for producing chlorine dioxide from chlorate in acidic medium' (Ekzo Nobel Inc.) CA 2156125 and H. Falgen, G. Sundstroem, J. Landfors and J. C. Sokol, 'Electrolytic process of producing chlorine dioxide', and U.S. Pat. No. 5,487,881 are known.

Combinations of steps in the acidic and alkaline pH range are likewise described, for example Gerhart Schwab, Mei Tsu Lee and James W. Bentley, 'Electrochemical bleaching of wood pulps', and in U.S. Pat. No. 4,617,099.

In addition to the electrochemical production of chemicals for chlorine bleaches, similar processes are described for perborate, persulfate and hydrogen peroxide. Examples of these are C. Daneault and S. Varennes, 'In situ electrochemical bleaching of thermomechanical pulp with sodium perborate', CA 2121375 and A. Wong, S. Wu, C. Chiu and J. Zhao, 'Persulfate bleaching of softwood kraft pulp', Pulp Pap. Can. 96 (1995), pp. 20–23 and M. Kageyama and Y. Watanabe, 'Manufacture of hydrogen peroxide by the reduction of oxygen at cathodes in aqueous alkali solutions' (Honshu Paper Co. Ltd.) CA 121:215924.

Representatives of the second group, in which metal complexes are used, are T. Tzedakis, Y. Benzada, M. Comtat and J. L. Seris, 'Electrochemical contribution to the development of biomimetic oxidation. Application to the bleaching of paper pulp', Recents Prog. Genie Procedes 9 (1995), pp. 195–200. In M. N. Hull and V. M. Yasnovsky, 'Electrochemical reductive bleaching of lignocellulosic pulp'. U.S. Pat. No. 4,596,630 describes metal-containing (chromium and vanadium) complexes with various chelating agents which are used in a continuous bleaching process. The same process type includes the process and materials described by M. N. Hull and V. M. Yasnovsky 'Process for the electrochemical reductive bleaching of lignocellulosic pulp', (International Paper Company) U.S. Pat. No. RE 32825 (reissue of U.S. Pat. No. 4,596,630). Again, organometallic compounds of heavy metals are used. The repeated electrochemical regeneration of the compound creates an environmentally friendly process.

Since paper bleaching is a large-scale industrial process, safe handling of the corresponding amounts (some 1000 metric tons) of heavy-metal-containing wastes is a major problem. This considerably increases the costs of industrial use.

In the case of delignification of lignin-containing materials such as chemical pulp, for example, using oxygen bleaching, appropriate pressure vessels are necessary, which are expensive. The known electrochemical processes have the advantage that they are not necessarily directly oxygen-dependent. In addition to the delignification of fibers, the quality of the fibers and the retention of the cellulose structures are essential. These may be increased by electrochemical processes. Examples of the best known electrochemical processes for delignification in which the cyanide-containing compound ferricyanide is used are found in Y.-S. Perng and C. W. Oloman, 'Kinetics of oxygen bleaching mediated by electrochemically generated ferricyanide', Tappi J. 77 (1994), pp. 115–126. See also M. N. Hull and V. M. Yasnovsky, 'Oxygen bleaching with ferricyanide of lignocellulosic material', and U.S. Pat. No. 4,622,101. Studies on the selectivity of the bleaching process are also discussed there. These processes also do not require the use of overpressure.

SUMMARY OF THE INVENTION

The present invention relates to a system for the electrochemical cleavage of compounds, wherein the system includes an aqueous mixture of the compound to be cleaved, at least one mediator which comprises no metals or heavy metals and at least two electrodes.

The system according to the invention preferably makes possible the delignification of pulp without the use of enzymes and without the use of chlorine-containing compounds and without the use of heavy-metal-containing complexes. In this case, the aqueous mixture is an aqueous pulp containing lignin-containing material.

However, the system according to the invention is also suitable for cleaving and solubilizing other substances, for example dyes. It is thus suitable also, for example, for bleaching dyed textiles. Such textiles can be dyed, for example, with various commercial dyes, but in particular with indigo or indigo-related dyes such as thioindigo.

The system according to the invention for the electrochemical activation of mediators is made up as follows: The electrodes used can be identical or different.

The electrodes consist, for example, of carbon, vanadium, iron, chromium, cobalt, lead, copper, nickel, zinc, tantalum, titanium, silver, platinum, platinated platinum, rhodium, gold or other transition or noble metals and alloys of the said compounds which, if appropriate, can comprise other elements.

The electrodes preferably consist of materials selected from the group consisting of noble metals, steels, stainless steels and carbon.

For example, the electrodes can consist of steel, Hastelloy®, chrome nickel, chrome steel, aluchrome, Incoloy®, tantalum or titanium, rhodium, platinum, gold or another noble metal. Particularly preferably, the electrodes consist of stainless steel, in turn preference being given to stainless steels of group 1.4xxx (as specified in DIN 17850).

The electrodes can, if appropriate, have a coating of the oxygen compounds of one or more of the specified components. The electrodes can, if appropriate, be coated or doped with other substances by vapor deposition, sputtering, galvanizing, ion-implantation or similar processes. The surface of the electrodes can be increased by suitable processes, e.g. by grinding, polishing, sand-blasting, etching or erosion.

Since the lignin to be degraded is present in insoluble form, it is not possible to bring it into direct contact with a solid electrode. Therefore, the system according to the invention comprises one or more of what are termed mediator molecules which have the task of, after electrochemical activation by an electrode, transmitting to the lignin their mediated reactivity, for example oxidizing power, reducing power or. free-radical properties.

The mediator is preferably selected from the group consisting of the aliphatic, cycloaliphatic, heterocyclic or aromatic NO—, NOH— or

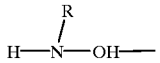

containing compounds.

The mediator is preferably at least one compound selected from the group consisting of the aliphatic, cycloaliphatic, heterocyclic or aromatic compounds which contain at least one N-hydroxy, oxime, nitroso, N-oxyl or N-oxy function.

Examples of compounds of this type are the compounds of the formulae I, II, III or IV mentioned below, the compounds of the formulae II, III and IV being preferred and the compounds of the formulae III and IV being particularly preferred.

Compounds of the general formula I are:

I

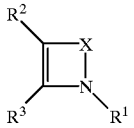

where X is one of the following groups:

(—N=N—), $(—N=CR^4—)_p$, $(—CR^4=N—)_p$, $(—CR^5=CR^6)_p$

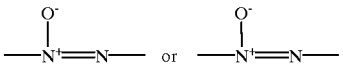

and p is 1 or 2, where the radicals $R^1$ and $R^6$ can be identical or different and independently of one another can be one of the following groups: hydrogen, halogen, hydroxyl, formyl, carboxyl and salts and esters thereof, amino, nitro, $C_1$–$C_{12}$-alkyl, $C_1$–$C_6$-alkyloxy, carbonyl-$C_1$–$C_6$-alkyl, phenyl, sulfono, esters and salts thereof, sulfamoyl, carbamoyl, phospho, phosphono, phosphonooxy and salts and esters thereof and where the amino, carbamoyl and sulfamoyl groups of the radicals $R^1$ to $R^6$ can in turn be unsubstituted or monosubstituted or disubstituted with hydroxyl, $C_1$–$C_3$-alkyl or $C_1$–$C_3$-alkoxy, and where the radicals $R^2$ and $R^3$ can form a joint group —A— and —A— here represents one of the following groups:

$(—CR^7=CR^8—CR^9=CR^{10}—)$ or $(—CR^{10}=CR^9—CR^8=CR^7—)$.

The radicals $R^7$ to $R^{10}$ can be identical or non-identical and independently of one another are one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, sulfono, esters and salts thereof, sulfamoyl, carbamoyl, phospho, phosphono, phosphonooxy and salts and esters thereof and where the amino, carbamoyl and sulfamoyl groups of the radicals $R^7$ to $R^{10}$ can additionally be unsubstituted or monosubstituted or disubstituted by hydroxyl, $C_1$—$C_3$-alkyl, $C_1$—$C_3$-alkoxy and where the $C_1$—$C_{12}$-alkyl, $C_1$—$C_6$-alkyloxy, carbonyl-$C_1$—$C_6$-alkyl, phenyl and aryl groups of the radicals $R^7$ to $R^{10}$ can be unsubstituted or additionally monosubstituted or polysubstituted by the radical $R^{11}$ and where the radical $R^{11}$ can be one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl and salts and esters thereof and where the carbamoyl, sulfamoyl and amino groups of the radical $R^{11}$ can be unsubstituted or additionally monosubstituted or disubstituted by the radical $R^{12}$ and where the radical $R^{12}$ can be one of the following groups: hydrogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl.

Examples of said compounds are:

1-hydroxy-1,2,3-triazole-4,5-dicarboxylic acid
1-phenyl-1H-1,2,3-triazole 3-oxide
5-chloro-1-phenyl-1H-1,2,3-triazole 3-oxide
5-methyl-1-phenyl-1H-1,2,3-triazole 3-oxide
4-(2,2-dimethylpropanoyl)-1-hydroxy-1H-1,2,3-triazole
4-hydroxy-2-phenyl-2H-1,2,3-triazole 1-oxide
2,4,5-triphenyl-2H-1,2,3-triazole 1-oxide
1-benzyl-1H-1,2,3-triazole 3-oxide
1-benzyl-4-chloro-1H-1,2,3-triazole 3-oxide
1-benzyl-4-bromo-1H-1,2,3-triazole 3-oxide
1-benzyl-4-methoxy-1H-1,2,3-triazole 3-oxide.

Compounds of the general formula II are:

II

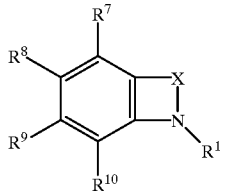

where X is one of the following groups: (—N=N—), $(—N=CR^4—)_p$, $(—CR^4=N—)_p$, $(—CR^5=CR^6)_p$

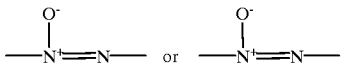

and p is 1 or 2.

The radicals $R^1$ and $R^4$ to $R^{10}$ can be identical or nonidentical and independently of one another are one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl, sulfono, esters and salts thereof, sulfamoyl, carbamoyl, phospho, phosphono, phosphonooxy and salts and esters thereof, and where the amino, carbamoyl and sulfamoyl groups of the radicals $R^1$ and $R^4$ to $R^{10}$ can additionally be unsubstituted or monosubstituted or disubstituted by hydroxyl, $C_1$—$C_3$-alkyl, $C_1$—$C_3$-alkoxy and where the $C_1$—$C_{12}$-alkyl, $C_1$—$C_6$-alkyloxy, carbonyl-$C_1$—$C_6$-alkyl, phenyl, aryl, aryl-$C_1$—$C_6$-alkyl groups of the radicals $R^1$ and $R^4$ to $R^{10}$ can be unsubstituted or additionally monosubstituted or disubstituted by the radical $R^{12}$ and where the radical $R^{12}$ can be one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl, sulfono, sulfeno, sulfino and salts and esters thereof and where the carbamoyl, sulfamoyl, amino groups of the radical $R^{12}$ can be unsubstituted or additionally monosubstituted or disubstituted by the radical $R^{13}$ and where the radical $R^{13}$ can be one of the following groups: hydrogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl.

Examples of said compounds are:

1-hydroxybenzimidazoles
1-hydroxybenzimidazole-2-carboxylic acid
1-hydroxybenzimidazole
2-methyl-1-hydroxybenzimidazole
2-phenyl-1-hydroxybenzimidazole
1-hydroxyindoles
2-phenyl-1-hydroxyindole Substances of the general formula III are:

III

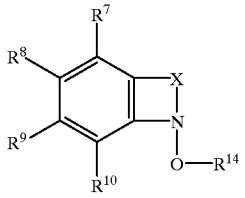

where X is one of the following groups:

(—N=N—), $(—N=CR^4—)_m$, $(—CR^4=N—)_m$, $(—CR^5=CR^6—)_m$

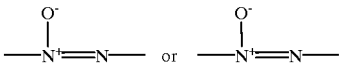

and m is 1 or 2.

The abovementioned applies to the radicals $R^7$ to $R^{10}$ and $R^4$ to $R^6$.

$R^{14}$ can be: hydrogen, $C_1$—$C_{10}$-alkyl, $C_1$—$C_{10}$-alkylcarbonyl, the $C_1$—$C_{10}$-alkyl and $_1$—$C_{10}$-alkylcarbonyl of which can be unsubstituted or monosubstituted or polysubstituted by a radical $R^{15}$, where $R^{15}$ can be one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, sulfono, esters and salts thereof, sulfamoyl, carbamoyl, phospho, phosphono, phosphonooxy and salts and esters thereof, where the amino, carbamoyl and sulfamoyl groups of the radical $R^{15}$ can additionally be unsubstituted or monosubstituted or disubstituted by hydroxyl, $C_1$—$C_3$-alkyl, $C_1$—$C_3$-alkoxy.

Of the substances of the formula III, in particular derivatives of 1-hydroxybenzotriazole and the tautomeric benzotriazole 1-oxide and esters and salts thereof are preferred (compounds of the formula IV)

IV

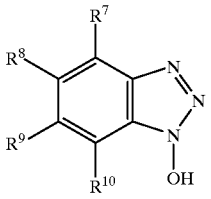

The radicals $R^7$ to $R^{10}$ can be identical or different and independently of one another are one of the following groups: hydrogen, halogen, hydroxyl, formyl, carboxyl and salts and esters thereof, amino, nitro, $C_1$—$C_{12}$, -alkyl, $C_1$—$C_6$-alkyloxy, carbonyl-$C_1$-$C_6$-alkyl, phenyl, sulfono, esters and salts thereof, sulfamoyl, carbamoyl, phospho, phosphono, phosphonooxy and salts and esters thereof and where the amino, carbamoyl and sulfamoyl groups of the radicals $R^7$ to $R^{10}$ can additionally be unsubstituted or monosubstituted or disubstituted by hydroxyl, $C_1$—$C_3$-alkyl, $C_1$—$C_3$-alkoxy and where the $C_1$—$C_{12}$-alkyl, $C_1$—$C_6$-alkyloxy, carbonyl-$C_1$—$C_6$-alkyl, phenyl, aryl groups of the radicals $R^7$ to $R^{10}$ can be unsubstituted or additionally monosubstituted or polysubstituted by the radical $R^{16}$ and where the radical $R^{16}$ can be one of the following groups: hydrogen, halogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl, sulfono, sulfeno, sulfino and esters and salts thereof and where the carbamoyl, sulfamoyl, amino groups of the radical $R^{16}$ can be unsubstituted or additionally monosubstituted or disubstituted by the radical $R^{17}$ and where the radical $R^{17}$ can be one of the following groups: hydrogen, hydroxyl, formyl, carboxyl and salts and esters thereof, amino, nitro, $C_1$—$C_{12}$-alkyl, $C_1$—$C_6$-alkyloxy, carbonyl-$C_1$—$C_6$-alkyl, phenyl, aryl.

Examples of said compounds are:

1H-hydroxybenzotriazoles
1-hydroxybenzotriazole
1-hydroxybenzotriazole, sodium salt
1-hydroxybenzotriazole, potassium salt
1hydroxybenzotriazole, lithium salt
1-hydroxybenzotriazole, ammonium salt
1-hydroxybenzotriazole, calcium salt
1-hydroxybenzotriazole, magnesium salt
1-hydroxybenzotriazole-6-sulfonic acid
1-hydroxybenzotriazole-6-sulfonic acid, monosodium salt
1-hydroxybenzotriazole-6-carboxylic acid
1-hydroxybenzotriazole-6-N-phenylcarboxamide
5-ethoxy-6-nitro-1-hydroxybenzotriazole
4-ethyl-7-methyl-6-nitro-1-hydroxybenzotriazole
2,3-bis(4-ethoxyphenyl)-4,6-dinitro-2,3-dihydro-1-hydroxybenzotriazole
2,3-bis(2-bromo-4-methylphenyl)-4,6-dinitro-2,3-dihydro-1-hydroxybenzotriazole
2,3-bis(4-bromophenyl)-4,6-dinitro-2,3-dihydro-1-hydroxy-benzotriazole
2,3-bis(4-carboxyphenyl)-4,6-dinitro-2,3-dihydro-1-hydroxybenzotriazole
4,6-bis(trifluoromethyl)-1-hydroxybenzotriazole
5-bromo-1-hydroxybenzotriazole
6-brono-1-hydroxybenzotriazole 4-bromo-7-methyl-1-hydroxybenzotriazole
5-bromo-7-methyl-6-nitro-1-hydroxybenzotriazole
4-bromo-6-nitro-1-hydroxybenzotriazole
6-bromo-4-nitro-1-hydroxybenzotriazole
4-chloro-1-hydroxybenzotriazole
5-chloro-1-hydroxybenzotriazole
6-chloro-1-hydroxybenzotriazole
4-chloro-5-isopropyl-1-hydroxybenzotriazole
5-chloro-6-methyl-1-hydroxybenzotriazole
6-chloro-5-methyl-1-hydroxybenzotriazole
4-chloro-7-inethyl-6-nitro-1-hydroxybenzotriazole
4-chloro-5-imethyl-1-hydroxybenzotriazole
5-chloro-4-methyl-1-hydroxybenzotriazole
4-chloro-6-nitro-1-hydroxybenzotriazole
6-chloro-4-nitro-1-hydroxybenzotriazole
7-chloro-1-hydroxybenzotriazole
6-diacetylaino-1-hydroxybenzotriazole
2,3-dibenzyl-4,6-dinitro-2,3-dihydro-1-hydroxybenzo-triazole
4,6-dibroio-1-hydroxybenzotriazole
4,6-dichloro-1-hydroxybenzotriazole
5,6-dichloro-1-hydroxybenzotriazole
4,5 -dichloro-1-hydroxybenzotriazole
4,7-dichloro-1-hydroxybenzotriazole
5,7-dichloro-6-nitro-1-hydroxybenzotriazole
5,6-dimethoxy-1-hydroxybenzotriazole
2,3-di[2]naphthyl-4,6-dinitro-2,3-dihydro-1-hydroxybenzo-triazole
4,6-dinitro-1-hydroxybenzotriazole
4,6-dinitro-2,3-diphenyl-2,3-dihydro-1-hydroxybenzo-triazole
4,6-dinitro-2,3-di-p-tolyl-2,3-dihydro-1-hydroxybenzo-triazole
5-hydrazino-7-methyl-4-nitro-1-hydroxybenzotriazole
5,6-dimethyl-1-hydroxybenzotriazole
4-methyl-1-hydroxybenzotriazole
5-methyl-1-hydroxybenzotriazole
6-methyl-1-hydroxybenzotriazole
5-(1-methylethyl)-1-hydroxybenzotriazole
4-mnethyl-6-nitro-1-hydroxybenzotriazole
6-mnethyl-4-nitro-1-hydroxybenzotriazole
5-methoxy-1-hydroxybenzotriazole
6-methoxy-1-hydroxybenzotriazole
7-nmethyl-6-nitro-1-hydroxybenzotriazole
4 -nitro-1-hydroxybenzotriazole
6-nitro-1-hydroxybenzotriazole
6-nitro-4-phenyl-1-hydroxybenzotriazole
5-phenylmethyl-1-hydroxybenzotriazole
4-trifluoromethyl-1-hydroxybenzotriazole
5-trifluoromethyl-1-hydroxybenzotriazole
6-trifluoromethyl-1-hydroxybenzotriazole
4,5,6,7-tetrachloro-1-hydroxybenzotriazole
4,5,6,7-tetrafluoro-1-hydroxybenzotriazole
6-tetrafluoroethyl-1-hydroxybenzotriazole
4,5,6-trichloro-1-hydroxybenzotriazole
4,6,7-trichloro-1-hydroxybenzotriazole
6-sulfamido-1-hydroxybenzotriazole
6-N,N-diethylsulfamido-1-hydroxybenzotriazole
6-N-methylsulfamido-1-hydroxybenzotriazole
6-(1H-1,2,4-triazol-1-ylmethyl)-1-hydroxybenzotriazole
6-(5,6,7,8-tetrahydroimidazo[1,5-a]pyridin-5-yl)-1-hydroxybenzotriazole
6-(phenyl-1H-1,2,4-triazol-1-ylmethyl)-1-hydroxybenzo-triazole
6-[(5-methyl-1H-imidazol-1-yl)phenylmethyl]-1-hydroxy-benzotriazole
6-[(4-methyl-1H-imidazol-1-yl)phenylmethyl]-1-hydroxy-benzotriazole
6-[(2-methyl-1H-iinidazol-1-yl)phenylmethyl]-1-hydroxy-benzotriazole
6-(1H-imidazol-1-ylphenylmethyl)-1-hydroxybenzotriazole
5-(1H-imidazol-1-ylphenylmethyl)-1-hydroxybenzotriazole
6-[1-(1H-imidazol-1-yl) ethyl]-1-hydroxybenzotriazole monohydrochloride
3H-benzotriazole 1-oxides
3H-benzotriazole 1-oxide
6-acetyl-3H-benzotriazole 1-oxide
5-ethoxy-6-nitro-3H-benzotriazole 1-oxide
4-ethyl-7-methyl-6-nitro-3H-benzotriazole 1-oxide
6-amino-3,5-dimethyl-3H-benzotriazole 1-oxide
6-amino-3-methyl-3H-benzotriazole 1-oxide
5-bromo-3H-benzotriazole 1-oxide
6-bromo-3H-benzotriazole 1-oxide
4-bromo-7-methyl-3H-benzotriazole 1-oxide
5-bromo-4-chloro-6-nitro-3H-benzotriazole 1-oxide
4-bromo-6-nitro-3H-benzotriazole 1-oxide
6-bromo-4-nitro-3H-benzotriazole 1-oxide
5-chloro-3H-benzotriazole 1-oxide
6-chloro-3H-benzotriazole 1-oxide
4-chloro-6-nitro-3H-benzotriazole 1-oxide
4,6-dibromo-3H-benzotriazole 1-oxide
4,6-dibrorno-3-methyl-3H-benzotriazole 1-oxide
4,6-dichloro-3H-benzotriazole 1-oxide
4,7-dichloro-3H-benzotriazole 1-oxide
5,6-dichloro-3H-benzotriazole 1-oxide
4,7-dichloro-3-methyl-3H-benzotriazole 1-oxide
5,7-dichloro-6-nitro-3H-benzotriazole 1-oxide
3,6-dimethyl-6-nitro-3H-benzotriazole 1-oxide
3,5-dimethyl-6-nitro-3H-benzotriazole 1-oxide
3-methyl-3H-benzotriazole 1-oxide
5-methyl-3H-benzotriazole 1-oxide
6-methyl-3H-benzotriazole 1-oxide
6-methyl-4-nitro-3H-benzotriazole 1-oxide
7-methyl-6-nitro-3H-benzotriazole 1-oxide
5-chloro-6-nitro-3H-benzotriazole 1-oxide
2H-benzotriazole 1-oxides
2-(4-acetoxyphenyl)-2H-benzotriazole 1-oxide
6-acetylamino-2-phenyl-2H-benzotriazole 1-oxide
2-(4-ethylphenyl)-4,6-dinitro-2H-benzotriazole 1-oxide
2-(3-aminophenyl)-2H-benzotriazole 1-oxide
2-(4-aminophenyl)-2H-benzotriazole 1-oxide
6-amino-2-phenyl-2H-benzotriazole 1-oxide
5-bromno-4 -chloro-6-nitro-2-phenyl-2H-benzotriazole 1-oxide
2- (4-bromophenyl) -2H-benzotriazole 1-oxide
5-bromo-2-phenyl-2H-benzotriazole 1-oxide
6-bromino-2-phenyl-2H-benzotriazole 1-oxide
2-(4-bromnophenyl) -4,6-dinitro-2H-benzotriazole 1-oxide
2-(4-bromnophenyl)-6-nitro-2H-benzotriazole 1-oxide
5-chloro-2-(2-chlorophenyl) -2H-benzotriazole 1-oxide
5-chloro-2-(3-choorophenyl)-2H-benzotriazole 1-oxide
5-chloro-2-(2,4- dibromophenyl)-2H-benzotriazole 1-oxide
5-chloro-2-(2,5-dimnethylphenyl) -2H-benzotriazole 1-oxide
5-chloro-2-(4-nitrophenyl )-2H-benzotriazole 1-oxide
5-chloro-6-nitro-2-phenyl-2H-benzotriazole 1-oxide
2-[4-(4-chloro-3-nitrophenylazo)-3-nitrophenyl]-4,6-di-nitro-2H-benzotriazole 1-oxide
2-(3-chloro-4-nitrophenyl)-4,6-dinitro-2H-benzotriazole 1-oxide
2-(4-chloro-3-nitrophenyl)-4,6-dinitro-2H-benzotriazole 1-oxide 4-chloro-6-nitro-2-p-tolyl-2H-benzotriazole 1-oxide
5-chloro-6-nitro-2-p-tolyl-2H-benzotriazole 1-oxide
6-chloro-4-nitro-2-p-tolyl-2H-benzotriazole 1-oxide
2-(2-chlorophenyl)-2H-benzotriazole 1-oxide
2-(3-chlorophenyl)-2H-benzotriazole 1-oxide
2-(4-chlorophenyl)-2H-benzotriazole 1-oxide
5-chloro-2-phenyl-2H-benzotriazole 1-oxide
2-(4-[4-chlorophenylazo)-3-nitrophenyl]-4,6-dinitro-2H-benzotriazole 1-oxide
2-(2-chlorophenyl)-4,6-dinitro-2H-benzotriazole 1-oxide
2-(3-chlorophenyl)-4,6-dinitro-2H-benzotriazole 1-oxide
2-(4-chlorophenyl)-4,6-dinitro-2H-benzotriazole 1-oxide
2-{4-[N'-(3-chlorophenyl)hydrazino]-3-nitrophenyl}-4,6-dinitro-2H-benzotriazole 1-oxide
2-{4-[N'-(4-chlorophenyl)hydrazino]-3-nitrophenyl}-4,6-dinitro-2H-benzotriazole 1-oxide
2-(2-chlorophenyl)-6-methyl-2H-benzotriazole 1-oxide
2-(3-chlorophenyl)-6-methyl-2H-benzotriazole 1-oxide
2-(4-chlorophenyl)-6-methyl-2H-benzotriazole 1-oxide
2-(3-chlorophenyl)-6-nitro-2H-benzotriazole 1-oxide
2-(4-chlorophenyl)-6-nitro-2H-benzotriazole 1-oxide
2-(4-chlorophenyl)-6-picrylazo-2H-benzotriazole 1-oxide
5-chloro-2-(2,4,5-trimethylphenyl)-2H-benzotriazole 1-oxide
4,5-dibromo-6-nitro-2-p-tolyl-2H-benzotriazole 1-oxide
4,5-dichloro-6-nitro-2-phenyl-2H-benzotriazole 1-oxide
4,5-dichloro-6-nitro-2-p-tolyl-2H-benzotriazole 1-oxide
4,7-dichloro-6-nitro-2-p-tolyl-2H-benzotriazole 1-oxide
4,7-dimethyl-6-nitro-2-phenyl-2H-benzotriazole 1-oxide
2-(2,4-dimethylphenyl)-4,6-dinitro-2H-benzotriazole 1-oxide
2-(2,5-dimethylphenyl)-4,6-dinitro-2H-benzotriazole 1-oxide
2-(2,4-dimethylphenyl)-6-nitro-2H-benzotriazole 1-oxide
2-(2,5-dimethylphenyl)-6-nitro-2H-benzotriazole 1-oxide
4,6-dinitro-2-[3-nitro-4-(N'-phenylhydrazino)phenyl]-2H-benzotriazole 1-oxide
4,6-dinitro-2-[4-nitro-4-(N'-phenylhydrazino)phenyl]-2H-benzotriazole 1-oxide
4,6-dinitro-2-phenyl-2H-benzotriazole 1-oxide
2-(2,4-dinitrophenyl) -4,6-dinitro-2H-benzotriazole 1-oxide
2-(2,4-dinitrophenyl) -6-nitro-2H-benzotriazole 1-oxide
4,6-dinitro-2-o-tolyl-2H-benzotriazole 1-oxide
4,6-dinitro-2-p-tolyl-2H-benzotriazole 1-oxide
4,6-dinitro-2-(2,4,5-triethyiphenyl)-2H-benzotriazole 1-oxide
2-(4-xnethoxyphenyl)-2H-benzotriazole 1-oxide
2-(4-methoxyphenyl )-6-ethyl -2H-benzotriazole 1-oxide
5-methyl-6-nitro-2-m-tolyl-2H-benzotriazole 1-oxide
5-methyl-6-nitro-2-o-tolyl-2H-benzotriazole 1-oxide
5-methyl-6-nitro-2-p-tolyl-2H-benzotriazole 1-oxide
6-methyl-4-nitro-2-p-tolyl-2H-benzotriazole 1-oxide
6-methyl-2-phenyl-2H-benzotriazole 1-oxide
4-methyl-2-m-tolyl-2H-benzotriazole 1-oxide
4-methyl-2-o-tolyl-2H-benzotriazole 1-oxide
4-methyl-2-p-tolyl-2H-benzotriazole 1-oxide
6-methyl-2-m-tolyl-2H-benzotriazole 1-oxide
6-methyl-2-o-tolyl-2H-benzotriazole 1-oxide
6-methyl-2-p-tolyl-2H-benzotriazole 1-oxide
2-[1]naphthyl-4,6-dinitro-2H-benzotriazole 1-oxide
2-[2]naphthyl-4,6-dinitro-2H-benzotriazole 1-oxide
2-[1]naphthyl-6-nitro-2H-benzotriazole 1-oxide
2-[2]naphthyl-6-nitro-2H-benzotriazole 1-oxide
2-[3]-nitrophenyl)-2H-benzotriazole 1-oxide
6-nitro-2-phenyl-2H-benzotriazole 1-oxide
4-nitro-2-p-tolyl-2H-benzotriazole 1-oxide
6-nitro-2-o-tolyl-2H-benzotriazole 1-oxide
6-nitro-2-p-tolyl-2H-benzotriazole 1-oxide
6-nitro-2-(2,4, 5-triethyl phenyl)-2H-benzotriazole 1-oxide
2-phenyl-2H-benzotriazole 1-oxide
2-o-tolyl- 2H-benzotriazole 1-oxide
2-p-tolyl-2H-benzotriazole 1-oxide The mediator can preferably be further selected from the group consisting of cyclic N-hydroxy compounds having at least one optionally substituted five- or six-membered ring containing the structure specified in formula V

V

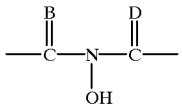

and salts, ethers or esters thereof, where

B and D are identical or different and are O, S or $NR^{18}$ where $R^{18}$ is hydrogen, hydroxyl, formyl, carbamoyl, sulfono radical, ester or salt of the sulfono radical, sulfamoyl, nitro, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phospho, phosphono, phosphonooxy radical, ester or salt of the phosphonooxy radical, where carbamoyl, sulfamoyl, amino and phenyl radicals can be unsubstituted or monosubstituted or polysubstituted by a radical $R^{19}$ and the aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{19}$ where $R^{19}$ is identical or different and is hydroxyl, formyl, carboxyl radical, ester or salt of the carboxyl radical, carbamoyl, sulfono, ester or salt of the sulfono radical, sulfamoyl, nitro, amino, phenyl, $C_1$—$C_5$-alkyl, $C_1$—$C_5$-alkoxy radical.

Preferably, the mediator is selected from the group consisting of the compounds of the general formulae VI, VII, VIII or IX,

VI

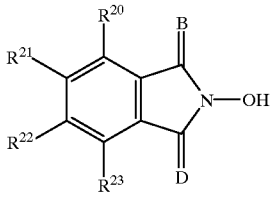

VII

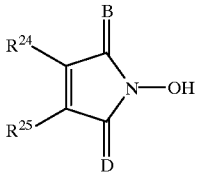

-continued

VIII

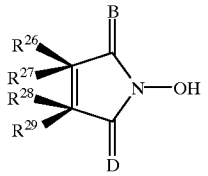

IX

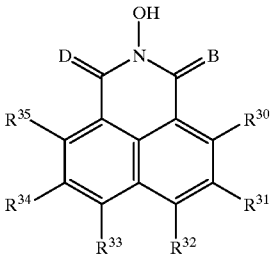

where B, D have the mneanings already specified and the radicals $R^{20}$—$R^{35}$ are identical or different and are halogen radical, carboxyl radical, salt or ester of a carboxyl radical or have the meanings specified for $R^{18}$, where $R^{26}$ and $R^{27}$, or $R^{28}$ and $R^{29}$, may not simultaneously be hydroxyl or amino radical and optionally two of the substituents $R^{20}$—$R^{23}$, $R^{24}$—$R^{25}$, $R^{26}$—$R^{29}$, $R^{30}$—$R^{35}$ can be linked in each case to form a ring —E—, where —E— has one of the following meanings:

$(—CH{=}CH)—_n$ where n=1 to 3, —CH=CH—CH=N— or

V

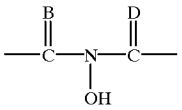

and where optionally the radicals $R^{26}$—$R^{29}$ can also be joined among one another by one or two bridge elements —F—, where —F— is identical or different and has one of the following meanings: —O—, —S—, $—CH_2—$, $—CR^{36}{=}CR^{37}—$;

where $R^{36}$ and $R^{37}$ are identical or different and have the meaning of $R^{20}$.

Mediators which are particularly preferred are compounds of the general formulae VI, VII, VIII or IX, in which B and D are O or S.

Examples of such compounds are N-hydroxyphthalimide and optionally substituted N-hydroxyphthalimide derivatives, N-hydroxymaleimide and optionally substituted N-hydroxymaleimide derivatives, N-hydroxynaphthalimide and optionally substituted N-hydroxynaphthalimide derivatives, N-hydroxysuccinimide and optionally substituted N-hydroxysuccinimide derivatives, preferably those in which the radicals $R^{26}$—$R^{29}$ are joined to form polycyclic compounds.

Mediators which are preferred in particular are N-hydroxyphthalimide, 4-amino-N-hydroxyphthalimide and 3-amino-N-hydroxyphthalimide.

Compounds of the formula VI suitable as mediators are, for example:

N-hydroxyphthalimide, 4-amino-N-hydroxyphthalimide, 3-amino-N-hydroxyphthalimide, N-hydroxybenzene-1,2,4-tricarboximide, N,N'-dihydroxypyromellitic diimide, N,N'-dihydroxybenzophenone-3,3',4,4'-tetracarboxylic dimide.

Compounds of the formula VII suitable as mediators are, for example:

N-hydroxymaleimide,

N-hydroxypyridine-2,3-dicarboximide.

Compounds of the formula VIII suitable as mediators are, for example:

N-hydroxysuccinimide,

N-hydroxytartarimide,

N-hydroxy-5-norbornene-2,3-dicarboximide, exo-N-hydroxy-7-oxabicyclo[2.2.1]hept-5-ene-2,3-dicarboximide, N-hydroxy-cis-cyclohexane-1,2-dicarboximide, N-hydroxy-cis-4-cyclohexene-1,2-dicarboximide.

A compound of the formula IX suitable as mediator is, for example:

N-hydroxynaphthalimide sodium salt.

A compound having a six-membered ring containing the structure mentioned in formula V suitable as mediator is, for example:

N-hydroxyglutarimide.

The compounds mentioned as examples are also suitable as mediator in the form of their salts or esters.

Compounds selected from the group consisting of N-aryl-N-hydroxyamides are likewise suitable as mediator.

Of these, compounds of the general formulae X, XI

X

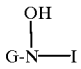

XI

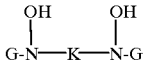

XII

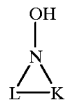

or XII are preferably used as mediators and salts, ethers or esters thereof, where G is a monovalent homoaromatic or heteroaromatic mono-cyclic or bicyclic radical and L is a divalent homoaromatic or heteroaromatic mono-cyclic or bicyclic radical and where these aromatics can be substituted by one or more identical or different radicals $R^{38}$ selected from the group consisting of halogen, hydroxyl, formyl, cyano, carbamoyl, carboxyl radical, ester or salt of the carboxyl radical, sulfono radical, ester or salt of the sulfono radical, sulfamoyl, nitro, nitroso, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phospho, phosphono, phosphonooxy radical, ester or salt of the phosphonooxy radical and where carbamoyl, sulfamoyl, amino and phenyl radicals can be unsubstituted or monosubstituted or polysubstituted by a radical $R^{39}$ and the aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{39}$, where $R^{39}$ is identical or different and is hydroxyl, formyl, cyano, carboxyl radical, ester or salt of the carboxyl radical, carbamoyl, sulfono, sulfamoyl, nitro, nitroso, amino, phenyl, $C_1$—$C_5$-alkyl, $C_1$—$C_5$-alkoxy, $C_1$—$C_5$-alkylcarbonyl radical and two of each of the radicals $R^{38}$ or $R^{39}$ can be linked in pairs via a bridge $[—C^{40}R^{41}—]_m$ where m is 0, 1, 2, 3 or 4 and $R^{40}$ and $R^{41}$ are identical or different and are carboxyl radical, ester or salt of the carboxyl radical, phenyl, $C_1$—$C_5$-alkyl, $C_1$—$C_5$-alkoxy, $C_1$—$C_5$-alkylcarbonyl radical and one or more non-adjacent groups $[—CR^{40}R^{41}—]$ can be replaced by oxygen, sulfur or an imino radical optionally sub-stituted by $C_1$ to $C_5$ alkyl radical and two adjacent groups $[—CR^{40}R^{41}—]$ can be replaced by a group $[—CR^{40}=CR^{41}—]$ and I is a monovalent acid radical present in amide form of acids selected from the group consisting of carboxylic acid having up to 20 C atoms, carbonic acid, half esters of carbonic acid or of carbamic acid, sulfonic acid, phosphonic acid, phosphoric acid, monoesters of phosphoric acid, diesters of phosphoric acid and K is a divalent acid radical present in amide form of acids selected from the group consisting of monocarboxylic and dicarboxylic acids having up to 20 C atoms, carbonic acid, sulfonic acid, phosphonic acid, phosphoric acid, monoesters of phosphoric acid.

Mediators which are particularly preferred are compounds of the general formulae XIII, XIV, XV, XVI or XVII:

XIII

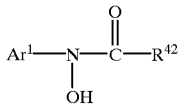

XIV

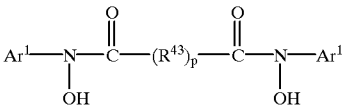

XV

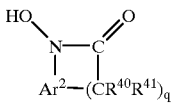

XVI

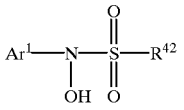

XVII

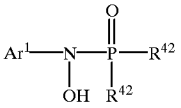

and salts, ethers or esters thereof, where $Ar^1$ is a monovalent homoaromatic or heteroaromatic monocyclic aryl radical and $Ar^2$ is a divalent homoaromatic or heteroaromatic monocyclic aryl radical, which can be substituted by one or more identical or different radicals $R^{44}$ selected from the group consisting of hydroxyl, cyano, carboxyl radical, ester or salt of the carboxyl radical, sulfono radical, ester or salt of the sulfono radical, nitro, nitroso, amino, $C_1$—$C_{12}$-alkyl, $C_1$—$C_5$-alkoxy, $C_1$—$C_{10}$-carbonyl, carbonyl-$C_1$—$C_6$-alkyl radical, where amino radicals can be unsubstituted or monosubstituted or polysubstituted by a radical $R^{45}$ and the $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched or can be monosubstituted or polysubstituted by a radical $R^{45}$, where $R^{45}$ is identical or different and is hydroxyl, carboxyl radical, ester or salt of the carboxyl radical, sulfono, nitro, amino, $C_1$—$C_5$-alkyl, $C_1$—$C_5$-alkoxy, $C_1$—$C_5$-alkylcarbonyl radical and two of each of the radicals $R^{44}$ can be linked in pairs via a bridge $[—CR^{40}R^{41}—]_m$ where mn is 0, 1, 2, 3 or 4 and $R_{40}$ and $R_{41}$ have the meanings already mentioned and one or more non-adjacent groups $[—CR^{40}R^{41}—]$ can be replaced by oxygen, sulfur or an imino radical optionally substituted by a $C_1$ to $C_5$ alkyl radical and two adjacent groups $[—CR^{40}R^{41}—]$ can be replaced by a group $[—CR^{40}=CR^{41}—]$, $R^{42}$ is identical or different nonovalent radicals selected from the group consisting of hydrogen, phenyl, aryl-$C_1$—$C_5$-alkyl, $C_1$—$C_{12}$-alkyl, $C_1$—$C_5$-alkoxy, $C_1$—$C_{10}$-carbonyl radical, where phenyl radicals can be unsubstituted or monosubstituted or polysubstituted by a radical $R^{46}$ and the aryl-$C_1$—$C_5$-alkyl, $C_1$—$C_{12}$-alkyl, $C_1$—$C_5$-alkoxy, $C_1$—$C_{10}$-carbonyl radicals can be saturated or unsaturated, branched or unbranched and can be monosubstituted or polysubstituted by a radical $R^{46}$, where $R^{46}$ is identical or different and is hydroxyl, formyl, cyano, carboxyl radical, ester or salt of the carboxyl radical, carbamoyl, sulfono, sulfamoyl, nitro, nitroso, amino, phenyl, $C_1$—$C_5$-alkyl, $C_1$—$C_5$-alkoxy radical and $R^{43}$ one divalent radicals selected from the group consisting of ortho-, meta-, para-phenylene, aryl-$C_1$—$C_5$-alkyl, $C_1$—$C_{12}$-alkylene, $C_1$—$C_5$-alkylenedioxy radical, where phenylene radicals can be unsubstituted or mono-substituted or polysubstituted by a radical $R^{46}$ and the aryl-$C_1$—$C_5$-alkyl, $C_1$—$C_{12}$-alkyl, $C_1$—$C_5$-alkoxy radicals can be saturated or unsaturated, branched or unbranched and can be monosubstituted or polysubstituted by a radical $R^{46}$, where p is 0 or 1 and q is an integer from 1 to 3.

Preferably, $Ar^1$ is a phenyl radical and $Ar^2$ is an ortho-phenylene radical, where $Ar^1$ can be substituted by up to five, and $Ar^2$ can be substituted by up to four, identical or different radicals selected from the group consisting of $C_1$—$C_3$-alkyl, $C_1$—$C_3$-alkylcarbonyl, carboxyl radical, ester or salt of the carboxyl radical, sulfono radical, ester or salt of the sulfono radical, hydroxyl, cyano, nitro, nitroso and amino radical, where amino radicals can be substituted by two different radicals selected from the group consisting of hydroxyl and $C_1$—$C_3$-alkylcarbonyl.

Preferably $R_{42}$ is a monovalent radical selected from the group consisting of hydrogen, phenyl, $C_1$—$C_{12}$-alkyl, $C_1$—$C_5$-alkoxy radical, where the $C_1$—$C_{12}$-alkyl radicals and $C_1$—$C_5$-alkoxy radicals can be saturated or unsaturated, branched or unbranched.

Preferably, $R^{43}$ are divalent radicals selected from the group consisting of ortho- or para-phenylene, $C_1$—$C_{12}$-alkylene, $C_1$—$C_5$-alkylenedioxy radical, where the aryl-$C_1$—$C_5$-alkyl, $C_1$—$C_{12}$-alkyl, $C_1$–$C_5$-alkoxy radicals can be saturated or unsaturated, branched or unbranched and can be monosubstituted or polysubstituted by a radical $R^{46}$.

Preferably, $R^{43}$ are carboxyl radical, ester or salt of the carboxyl radical, carbamoyl, phenyl, $C_1$—$C_3$-alkoxy radical.

Examples of compounds which can be used as mediators are N-hydroxyacetanilide, N-hydroxypivaloyl-anilide, N-hydroxyacrylanilide, N-hydroxybenzoylanilide, N-hydroxymethylsulfonylanilide, methyl N-hydroxy-N-phenyl-carbamate, N-hydroxy-3-oxobutyrylanilide, N-hydroxy-4-cyanoacetanilide, N-hydroxy-4-methoxyacetanilide, N-hydroxyphenacetin, N-hydroxy-2,3-dimethylacetanilide, N-hydroxy-2-methylacetanilide, N-hydroxy-4-methylacet-anilide, 1-hydroxy-3,4-dihydroquinolin-(1H)-2-one, N,N'-dihydroxy-N,N'-diacetyl-1,3-phenylenediamine, N,N'-dihydroxysuccinic dianilide, N,N'-dihydroxymaleic dianilide, N,N'-dihydroxyoxalic dianilide, N,N'-dihydroxyphosphoric dianilide, N-acetoxyacetanilide, N-hydroxymethyloxalylanilide, N-hydroxymaleic monoanilide.

Mediators which are preferred are N-hydroxyacet-anilide, N-hydroxyformanilide, methyl N-hydroxy-N-phenylcarbamate, N-hydroxy-2-methylacetanilide, N-hydroxy-4-methylacetanilide, 1-hydroxy-3,4-dihydroquinolin-(1H)-2-one and N-acetoxyacetanilide.

The mediator can further be selected from the group consisting of the N-alkyl-N-hydroxyamides.

Preferably, the mediators used in this case are compounds of the general formulae (XVIII) or (XIX)

(XVIII)

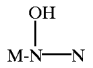

(XIX)

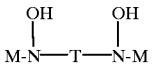

and salts, ethers or esters thereof, where

M is identical or different and is a monovalent unbranched or branched or cyclic or polycyclic saturated or unsaturated alkyl radical having 1–24 C atoms and where this alkyl radical can be substituted by one or more radicals $R^{48}$ which are identical or different and are selected from the group consisting of hydroxyl, mercapto, formyl, carbamoyl, carboxyl, ester or salt of the carboxyl radical, sulfono radical, ester or salt of the sulfono radical, sulfamoyl, nitro, nitroso, amino, hydroxylamino, phenyl, $C_1$–$C_5$-alkoxy, $C_1$—$C_{10}$-carbonyl, phospho, phosphono, phosphonooxy radical, ester or salt of the phosphonooxy radical and where carbamoyl, sulfamoyl, amino, hydroxylamino, mercapto and phenyl radicals can be unsubstituted or monosubstituted or polysubstituted by a radical $R^{48}$ and the $C_1$—$C_5$-alkoxy, $C_1$—$C_{10}$-carbonyl radicals can be saturated or unsaturated, branched or unbranched and can be monosub-stituted or polysubstituted by a radical $R^{48}$, where $R^{48}$ is identical or different and is hydroxyl, formyl, cyano, carboxyl radical, ester or salt of the carboxyl radical, carbamoyl, sulfono, sulfamoyl, nitro, nitroso, amino, phenyl, benzoyl, $C_1$—$C_5$-alkyl, $C_1$—$C_5$-alkoxy, $C_1$—$C_5$-alkylcarbonyl radical and methylene groups not in the α position can be replaced by oxygen, sulfur or an optionally monosubstituted imino radical and N is a monovalent acid radical present in amide form of acids selected from the group consisting of aliphatic or monocyclic or bicyclic aromatic or monocyclic or bicyclic heteroaromatic carboxylic acids having up to 20 C atoms, carbonic acid, half esters of carbonic acid, or of carbamic acid, sulfonic acid, phosphonic acid, phosphoric acid, monoesters of phosphoric acid, diesters of phosphoric acid and T is a divalent acid radical present in amide form of acids selected from the group consisting of aliphatic, monocyclic or bicyclic aromatic or monocyclic or bicyclic heteroaromatic dicarboxylic acids having up to 20 C atoms, carbonic acid, sulfonic acid, phosphonic acid, phosphoric acid, monoesters of phosphoric acid and where alkyl radicals of the aliphatic acids present in amide form N and T can be unbranched or branched and/or cyclically and/or polycyclically saturated or unsaturated and contain 0–24 carbon atoms and are unsubstituted or monosubstituted or polysubstituted by the radical $R^{47}$ and aryl and heteroaryl radicals of the aromatic or heteroaromatic acids present in amide form N and T can be substituted by one or more radicals $R^{49}$ which are identical or different and are selected from the group consisting of hydroxyl, mercapto, formyl, cyano, carbamoyl, carboxyl, ester or salt of the carboxyl radical, sulfono radical, ester or salt of the sulfono radical, sulfamoyl, nitro, nitroso, amino, phenyl, aryl-$C_1$—$C_5$-alkyl, $C_1$—$C_{12}$-alkyl, $C_1$—$C_5$-alkoxy, $C_1$—$C_{10}$-carbonyl, phospho, phosphono, phosphonooxy radical, ester or salt of the phosphonooxy radical and where carbamoyl, sulfamoyl, amino, mercapto and phenyl radicals can be unsubstituted or monosubstituted or polysubstituted by the radical $R^{48}$ and the aryl-$C_1$—$C_5$-alkyl, $C_1$—$C_{12}$-alkyl, $C_1$—$C_5$-alkoxy, $C_1$—$C_{10}$-carbonyl radicals can be saturated or unsaturated, branched or unbranched and can be monosubstituted or polysubstituted by the radical $R^{48}$.

Mediators which are particularly preferred are compounds having the general formulae (XX, XXI, XXII or XXIII):

(XX)

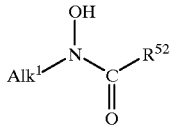

(XXI)

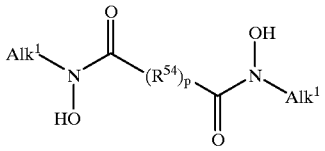

(XXII)

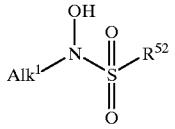

(XXIII)

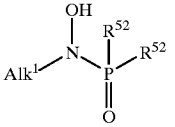

and salts,, ethers or esters thereof, where $Alk^1$ is identical or different and is a mnonovalent unbranched or branched or cyclic or polycyclic saturated or unsaturated alkyl radical having 1–10 C atoms, where this alkyl radical can be substituted by one or more radicals $R^{50}$ which are identical or different and are selected from the group consisting of hydroxyl, formyl, carbamoyl, carboxyl, ester or salt of the carboxyl radical, sulfono radical, ester or salt of the sulfono radical, sulfamoyl, nitro, nitroso, amino, hydroxylamino, phenyl, $C_1$—$C_5$-alkoxy, $C_1$—$C_5$-carbonyl radicals and where carbamoyl, sulfamoyl, amino, hydroxylamino and phenyl radicals can be unsubstituted or monosubstituted or polysubstituted by a radical $R^{51}$ and the $C_1$—$C_5$-alkoxy, $C_1$—$C^{10}$-carbonyl radicals can be saturated or unsaturated, branched or unbranched and can be monosubstituted or polysubstituted by a radical $R^{51}$, where $R^{51}$ is identical or different and is hydroxyl, formyl, cyano, carboxyl radical, ester or salt of the carboxyl radical, carbamoyl, sulfono, sulfamoyl, nitro, amino, phenyl, benzoyl, $C_1$—$C_5$-alkyl, $C_1$—$C_5$-alkoxy, $C_1$—$C_5$-alkylcarbonyl radical and, methylene groups not in the α position can be replaced by oxygen, sulfur or an optionally monosubstituted imino radical and where $R^{53}$ is identical or different monovalent radicals selected from the group consisting of hydrogen, phenyl, pyridyl, furyl, pyrrolyl, thienyl, aryl-$C_1$—$C_5$-alkyl, $C_1$—$C_{12}$-alkyl, $C_1$—$C_{10}$-alkoxy, $C_1$—$C_{10}$-carbonyl radical, where phenyl, pyridyl, furyl, pyrrolyl and thienyl radicals can be unsubstituted or monosubstituted or polysubstituted by a radical $R^7$ and the aryl-$C_1$—$C_5$-alkyl, $C_1$—$C_{12}$-alkyl, $C_1$—$C_5$-alkoxy and $C_1$—$C_{10}$-carbonyl radicals can be saturated or unsaturated, branched or unbranched and can be monosubstituted or polysubstituted by a radical $R^{53}$ and $R^{53}$ is identical or different and is hydroxyl, formyl, carboxyl radical, ester or salt of the carboxyl radical, carbamoyl, sulfono, sulfamoyl, nitro, amino, phenyl, $C_1$—$C_5$-alkyl, $C_1$—$C_5$-alkoxy radical and $R^{54}$ is a divalent radical selected from the group consisting of phenylene, pyridylene, thienylene, furylene, pyrrolylene, aryl-$C_1$—$C_5$-alkyl, $C_1$—$C_{12}$-alkylene, $C_1$—$C_5$-alkylenedioxy radical, where phenylene, pyridylene, thienylene, furylene, pyrrolylene can be unsubstituted or monosubstituted or polysubstituted by a radical $R^{53}$ and the aryl-$C_1$—$C_5$-alkyl, $C_1$—$C_{12}$-alkyl, $C_1$—$C_5$-alkoxy radicals can be saturated or unsaturated, branched or unbranched and can be monosubstituted or polysubstituted by a radical $R^{53}$, where p is 0 or 1.

Mediators which are very particularly preferred are compounds having the general formula (XX–XXIII), in which $Alk^1$ is identical or different and is a monovalent unbranched or branched or cyclic saturated or unsaturated alkyl radical having 1–10 C atoms, where this alkyl radical can be substituted by one or more radicals $R^{50}$ which are identical or different and are selected from the group consisting of hydroxyl, carbamoyl, carboxyl, ester or salt of the carboxyl radical, sulfono radical, ester or salt of the sulfono radical, sulfamoyl, amino, phenyl, $C_1$—$C^5$-alkoxy, $C_1$—$C_5$-carbonyl radicals and where carbamoyl, sulfamoyl, amino and phenyl radicals can be unsubstituted or monosubstituted or polysubstituted by a radical $R^{51}$ and the $C_1$—$C_5$-alkoxy, $C_1$—$C_{10}$-carbonyl radicals can be saturated or unsaturated, branched or unbranched and monosubstituted or polysubstituted by a radical $R^{51}$, where $R^{51}$ is identical or different and is hydroxyl, carboxyl radical, ester or salt of the carboxyl radical, carbamoyl, sulfono, sulfamoyl, nitro, amino, phenyl, benzoyl, $C_1$—$C_5$-alkyl, $C_1$—$C_5$-alkoxy, $C_1$—$C_5$-alkylcarbonyl radical and where $R^{52}$ is identical or different monovalent radicals selected from the group consisting of hydrogen, phenyl, furyl, aryl-$C_1$—$C_5$-alkyl, $C_1$—$C_{12}$-alkyl, $C_1$—$C_{10}$-alkoxy, $C_3$—$C_{10}$-carbonyl radical, where phenyl and furyl radicals can be unsubstituted or monosubstituted or polysubstituted by a radical $R^{53}$ and the aryl-$C_1$—$C_5$-alkyl, $C_1$—$C_{12}$-alkyl, $C_1$—$C_5$-alkoxy and $C_1$—$C_{10}$-carbonyl radicals can be saturated or unsaturated, branched or unbranched and can be monosubstituted or polysubstituted by a radical $R^{53}$, where $R^{53}$ is identical or different and is a carboxyl radical, ester or salt of the carboxyl radical, carbamoyl, phenyl, $C_1$—$C_5$-alkyl, $C_1$—$C_5$-alkoxy radical and $R^{54}$ is a divalent radical selected from the group consisting of phenylene, furylene, $C_1$—$C_{12}$-alkylene, $C_1$—$C_5$-alkylenedioxy radical, where phenylene, furylene can be unsubstituted or monosubstituted or polysubstituted by a radical $R^{53}$ and the aryl-$C_1$—$C_5$-alkyl, $C_1$—$C_{12}$-alkyl, $C_1$—$C_5$-alkoxy radicals can be saturated or unsaturated, branched or unbranched and can be monosubstituted or polysubstituted by a radical $R^{53}$, where p is 0 or 1.

Examples of compounds which can be used as mediators are

N-hydroxy-N-methylbenzoamide,
N-hydroxy-N-methylbenzenesulfona-mide,
N-hydroxy-N-methyl-p-toluenesulfonamide,
N-hydroxy-N-methylfuran-2-carboxamide,
N-hydroxy-N-methylthiophene-2-carboxamide,
N,N'-dihydroxy-N,N'-diimethylphthalic diamide
N,N'-dihydroxy-N,N'-dimethylisophthalic diamide,
N,N'-dihydroxy-N,N'-dimethylterephthalic diaiuide,
N,N'-dihydroxy-N,N'-dimethylbenzene-1,3-disulfonic diamide,
N,N'-dihydroxy-N,N'-dimethylfuran-3,4-dicarboxamide,
N-hydroxy-N-tert-butylbenzoamide,
N-hydroxy-N-tert-butylbenzenesulfonamide,
N-hydroxy-N-tert-butyl-p-toluenesulfonamide,
N-hydroxy-N-tert-butylfuran-2-carboxamide,
N-hydroxy-N-tert-butylthiophene-2-carboxaiide,
N,N'-dihydroxy-N,N1-di-tert-butylphthalic diaiide,
N,N'-dihydroxy-N,N1-di-tert-butylisophthalic diamide,
N,N'-dihydroxy-N,N'-di-tert-butylterephthalic diamide,
N,N'-dihydroxy-N,N'-di-tert-butylbenzene-1,3-disulfondiamide,
N,N'-dihydroxy-N,N'-di-tert-butylfuran-3,4-dicarboxdiamide,
N-hydroxy-N-cyclohexylbenzoamide,
N-hydroxy-N-cyclohexylbenzenesulfonamide,
N-hydroxy-N-cyclohexyl-p-toluenesulfonamide,
N-hydroxy-N-cyclohexylfuran-2-carboxamide,
N-hydroxy-N-cyclohexylthiophene-2-carboxamide,
N,N'-dihydroxy-N,N'-dicyclohexylphthalic diamide,
N,N'-dihydroxy-N,N'-dicyclohexylisophthalic diamide,
N,N'-dihydroxy-N,N'-dicyclohexylterephthalic diamide,
N,N'-dihydroxy-N,N'-dicyclohexylbenzene-1,3-disulfonamide,
N,N'-dihydroxy-N,N'-dicyclohexylfuran-3,4-dicarboxdiamide,
N-hydroxy-N-isopropylbenzoamide,
N-hydroxy-N-isopropylbenzenesulfonamide,
N-hydroxy-N-isopropyl-p-toluenesulfonamide,
N-hydroxy-N-isopropylfuran-2-carboxamide,
N-hydroxy-N-isopropylthiophene-2-carboxamide,
N,N'-dihydroxy-N,N'-diisopropylphthalic diamide,
N,N'-dihydroxy-N,N'-diisopropylisophthalic diamide,
N,N'-dihydroxy-N,N'-diisopropylterephthalic diamide,
N,N'-dihydroxy-N,N'-diisopropylbenzene-1,3-disulfondiamide,
N,N'-dihydroxy-N,N'-diisopropylfuran-3,4-dicarboxdiamide,
N-hydroxy-N-methylacetamide,
N-hydroxy-N-tert-butylacetamide,
N-hydroxy-N-isopropylacetamide,
N-hydroxy-N-cyclohexylacetamide, N-hydroxy-N-methylpivalamide,
N-hydroxy-N-isopropylpivalamide,
N-hydroxy-N-methylacrylamide,
N-hydroxy-N-tert-butylacrylamide,
N-hydroxy-N-isopropylacrylamide,
N-hydroxy-N-cyclohexylacrylamide,
N-hydroxy-N-methylmethanesulfonamide,
N-hydroxy-N-isopropylmethanesulfonamide,
methyl N-hydroxy-N-isopropylcarbamate,
N-hydroxy-N-methyl-3-oxobutyramide,
N,N'-dihydroxy-N,N'-dibenzoylethylenediamine,
N,N'-dihydroxy-N,N'-dimethylsuccinic diamide,
N,N'-dihydroxy-N,N'-di-tert-butylmaleic diamide,
N-hydroxy-N-tert-butylmaleic monoamide,
N,N'-dihydroxy-N,N'-di-tert-butyloxalic diamide,
N,N'-dihydroxy-N,N'-di-tert-butylphosphoric diamide.

As mediators, compounds are preferably selected from the group consisting of

N-hydroxy-N-methylbenzoamide,
N-hydroxy-N-methylbenzenesulfonamide
N-hydroxy-N-methyl-p-toluenesulfonamide,
N-hydroxy-N-methylfuran-2-carboxamide,
N,N'-dihydroxy-N,N'-dimethylphthalic diamide,
N,N'-dihydroxy-N,N'-dimethylterephthalic diamide,
N,N'-dihydroxy-N,N'-dimethylbenzene-1,3-disulfonic diamide,
N-hydroxy-N-tert-butylbenzoamide,
N-hydroxy-N-tert-butylbenzenesulfonamide,
N-hydroxy-N-tert-butyl-p-toluenesulfonamide,
N-hydroxy-N-tert-butylfuran-2-carboxamide,
N,N'-dihydroxy-N,N'-di-tert-butylterephthalic diamide,
N-hydroxy-N-isopropylbenzoamide,
N-hydroxy-N-isopropyl-p-toluenesulfonamide,
N-hydroxy-N-isopropylfuran-2-carboxamide,
N,N'-dihydroxy-N,N'-diisopropylterephthalic diamide,
N,N'-dihydroxy-N,N'-diisopropylbenzene-1,3-disulfonic diamide,
N-hydroxy-N-methylacetamide,
N-hydroxy-N-tert-butylacetamide,
N-hydroxy-N-isopropylacetamide, N-hydroxy-N-cyclohexyl-acetamide,
N-hydroxy-N-methylpivalamide
N-hydroxy-N-tert-butylacrylamide,
N-hydroxy-N-isopropylacrylamide,
N-hydroxy-N-inethyl-3-oxobutyramide,
N,N'-dihydroxy-N,N'-dibenzoylethylenediamine,
N,N'-dihydroxy-N,N'-di-tert-butylmaleic diamide,
N-hydroxy-N-tert-butylmaleic monoamide,
N,N'-dihydroxy-N,N'-di-tert-butyloxalic diamide.

The mediator can further be selected from the group consisting of the oximes of the general formulae XXIV or XXV

XXIV

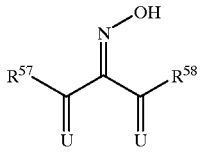

-continued

XXV

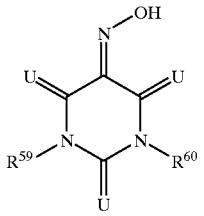

and salts, ethers or esters thereof, where

U is identical or different and is O, S or $NR^{55}$, where $R^{55}$ is hydrogen, hydroxyl, formyl, carbamoyl, sulfono radical, ester or salt of the sulfono radical, sulfamoyl, nitro, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phosphor phosphono, phosphonooxy radical, ester or salt of the phosphonooxy radical, where carbamoyl, sulfamoyl, amino and phenyl radicals can be unsubstituted or monosubstituted or polysubstituted by a radical $R^{56}$ and the aryl-$C_1$—$C^5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{56}$, where $R^{56}$ is identical or different and is hydroxyl, formyl, carboxyl radical, ester or salt of the carboxyl radical, carbamoyl, sulfono, ester or salt of the sulfono radical, sulfamoyl, nitro, amino, phenyl, $C_1$—$C_5$-alkyl, $C_1$—$C_5$-alkoxy radical and the radicals $R^{57}$ and $R^{58}$ are identical or different and are halogen, carboxyl radical, ester or salt of the carboxyl radical, or have the meanings mentioned for $R^{55}$, or are linked to form a ring $[—CR^{61}R^{62}]_n$ where n is 2, 3 or 4 and $R^{59}$ and $R^{60}$ have the meanings mentioned for $R^{55}$ and $R^{61}$ and $R^{62}$ are identical or different and are halogen, carboxyl radical, ester or salt of the carboxyl radical, or have the meanings mentioned for $R^{55}$.

As mediators, particular preference is given to compounds having the general formula XXIV in which U is O or S and the remaining radicals have the meanings mentioned above. One example of such a compound is dimethyl 2-hydroxyiminomalonate.

As mediators, further particular preference is given to isonitroso derivatives of cyclic ureides of the general formula XXV. Examples of such compounds are 1-methylvioluric acid, 1,3-dimethylvioluric acid, thiovioluric acid, alloxan 4,5-dioxime.

As mediator, in particular preference is given to alloxan 5-oxime hydrate (violuric acid) and/or esters, ethers or salts thereof.

The mediator can in addition be selected from the group consisting of vicinal nitrososubstituted aromatic alcohols of the general formulae XXVI or XXVII

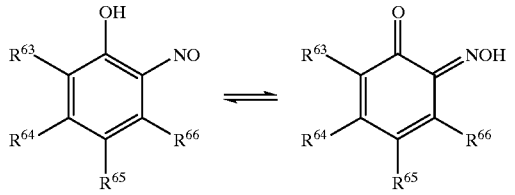

XXVI XXVII and salts, ethers or esters thereof, where $R^{63}$, $R^{64}$, $R^{65}$ and $R^{66}$ are identical or different and are hydrogen, halogen, hydroxyl, formyl, carbamoyl, carboxyl radical, ester or salt of the carboxyl radical, sulfono radical, ester or salt of the sulfono radical, sulfamoyl, nitro, nitroso, cyano, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phospho, phosphono, phosphonooxy radical, ester or salt of the phosphonooxy radical, where carbamoyl, sulfamoyl, amino and phenyl radicals can be unsubstituted or monosubstituted or polysubstituted by a radical $R^{67}$ and the aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{67}$, where $R^{67}$ is identical or different and is hydroxyl, formyl, carboxyl radical, ester or salt of the carboxyl radical, carbamoyl, sulfono, sulfamoyl, nitro, nitroso, amino, phenyl, $C_1$—$C_5$-alkyl, $C_1$—$C_5$-alkoxy radical or the radicals $R^{63}$–$R^{66}$ are linked in pairs to form a ring $[—CR^{68}R^{69}—]_m$, where m is an integer and has a value from 1 to 4, or are linked to form a ring $[—CR^{70}=CR^{71}—]_n$, where n is an integer and has a value from 1 to 3, and $R^{68}$, $R^{69}$, $R^{70}$ and $R^{71}$ are identical or different and have the meanings mentioned for $R^{63}$ to $R^{66}$.

Aromatic alcohols are preferably taken to mean phenols or higher condensed derivatives of phenol.

As mediators, preference is given to compounds of the general formulae XXVI or XXVII whose synthesis is based on the nitrosation of substituted phenols. Examples of such compounds are 2-nitrosophenol, 3-methyl-6-nitrosophenol, 2-methyl-6-nitrosophenol, 4-methyl-6-nitrosophenol, 3-ethyl-6-nitrosophenol, 2-ethyl-6-nitrosophenol, 4-ethyl-6-nitrosophenol, 4-isopropyl-6-nitrosophenol, 4-tert-butyl-6-nitrosophenol, 2-phenyl-6-nitrosophenol, 2-benzyl-6-nitrosophenol, 4-benzyl-6-nitrosophenol, 2-hydroxy-3-nitrosobenzyl alcohol, 2-hydroxy-3-nitrosobenzoic acid, 4-hydroxy-3-nitrosobenzoic acid, 2-methoxy-6-nitrosophenol, 3,4-dimethyl-6-nitrosophenol, 2,4-dimethyl-6-nitrosophenol, 3,5-dimethyl-6-nitrosophenol, 2,5-dimethyl-6-nitrosophenol, 2-nitrosoresorcinol, 4-nitrosoresorcinol, 2-nitrosoorcinol, 2-nitrosophloroglucin and 4-nitroso-pyrogallol, 4-nitroso-3-hydroxyaniline, 4-nitro-2-nitrosophenol.

As mediators, further preference is given to o-nitroso derivatives of higher condensed aromatic alcohols. Examples of such compounds are 2-nitroso-1-naphthol, 1-methyl-3-nitroso-2-naphthol and 9-hydroxy-10-nitrosophenanthrene.

As mediators, particular preference is given to 1-nitroso-2-naphthol, 1-nitroso-2-naphthol-3,6-disulfonic acid, 2-nitroso-1-naphthol-4-sulfonic acid, 2,4-dinitroso-1,3-dihydroxybenzene and esters, ethers or salts of said compounds.

The mediator can additionally be selected from the group consisting of hydroxypyridines, aminopyridines, hydroxyquinolines, aminoquinolines, hydroxyisoquinolines, aminoisoquinolines having nitroso or mercapto substituents ortho or para to the hydroxy or amino groups, tautomers of said compounds and salts, ethers and esters thereof.

Preference is given as mediators to compounds of the general formulae (XXVIII), (XXIX) or (XXX)

(XXVIII)

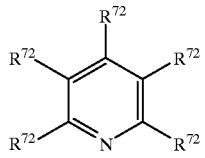

(XXIX)

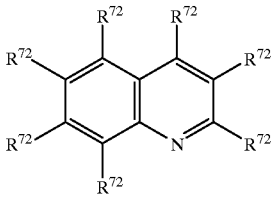

(XXX)

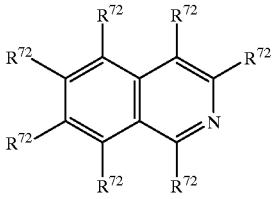

and to tautomers, salts, ethers or esters of said compounds present, where in the formulae XXVIII, XXIX or XXX two radicals $R^{72}$ ortho or para to one another are hydroxyl and nitroso radical or hydroxyl and mercapto radical or nitroso radical and amino radical and the remaining radicals $R^{72}$ are identical or different and are selected from the group consisting of hydrogen, halogen, hydroxyl, mercapto, formyl, cyano, carbamoyl, carboxyl radical, ester and salt of the carboxyl radical, sulfono radical, ester and salt of the sulfono radical, sulfamoyl, nitro, nitroso, amino, phenyl, aryl-$C_1$—$C_5$-alkyl, $C^1$—$C_{12}$-alkyl, $C_1$—$C_5$-alkoxy, $C_1$—$C_{10}$-carbonyl, carbonyl-$C_1$—$C^6$-alkyl, phospho, phosphono, phosphonooxy radical, ester and salt of the phosphonooxy radical and where carbamoyl, sulfamoyl, amino, mercapto and phenyl radicals can be unsubstituted or monosubstituted or polysubstituted by a radical $R^{73}$ and the aryl-$C^1$—$C^5$-alkyl, $C_1$—$C_{12}$-alkyl, $C_1$—$C_5$-alkoxy, $C_1$—$C_{10}$-carbonyl, carbonyl-$C_1$—$C^6$-alkyl radicals can be saturated or unsaturated, branched or unbranched and can be monosubstituted or polysubstituted by a radical $R^{73}$, where $R^{73}$ is identical or different and is hydroxyl, formyl, cyano, carboxyl radical, ester or salt of the carboxyl radical, carbamoyl, sulfono, sulfamoyl, nitro, nitroso, amino, phenyl, $C_1$—$C_5$-alkyl, $C_1$—$C_5$-alkoxy radical or $C_1$—$C_5$-alkylcarbonyl radical and two of each of the radicals $R^{72}$ or two radicals $R^{73}$ or $R^{72}$ and $R^{73}$ can be linked in pairs via a bridge $[—CR^{74}R^{75}—]_m$ where m is 1, 2, 3 or 4 and $R^3$ and $R^4$ are identical or different and are carboxyl radical, ester or salt of the carboxyl radical, phenyl, $C_1$—$C^5$-alkyl, $C_1$—$C^5$-alkoxy radical or $C^1$—$C^5$-alkylcarbonyl radical and one or more non-adjacent groups $[—CR^{74}R^{75}—]$ can be replaced by oxygen, sulfur or an imino radical optionally substituted by $C_1$—$C_5$-alkyl and two adjacent groups $[—CR^{74}R^{75}—]$ can be replaced by a group $[—CR^{74}=R^{75}—]$.

As mediators, particular preference is given to compounds of the general formulae (XXVIII) or (XXIX) and to their tautomers, salts, ethers or esters, where in the formulae (XXVIII) and (XXIX) particularly preferably two radicals $R^{72}$ ortho to one another-are hydroxyl and nitroso radical or hydroxyl and mercapto radical or nitroso radical and amino radical and the remaining radicals $R^{72}$ are identical or different and are selected from the group consisting of hydrogen, hydroxyl, mercapto, formyl, carbamoyl, carboxyl radical, ester and salt of the carboxyl radical, sulfono radical, ester and salt of the sulfono radical, sulfamoyl, nitro, nitroso, amino, phenyl, aryl-$C_1$—$C_5$-alkyl, $C_1$—$C^5$-alkyl, $C_1$—$C^5$-alkoxy, $C^1$—$C_5$-carbonyl, carbonyl-$C_1$—$C_6$-alkyl, phospho, phosphono, phosphonooxy radical, ester and salt of the phosphonooxy radical where carbamoyl, sulfamoyl, amino, mercapto and phenyl radicals can be unsubstituted or monosubstituted or polysubstituted by a radical $R^{73}$ and the aryl-$C_1$—$C_5$-alkyl, $C_1$—$C_5$-alkyl, $C_1$—$C_5$-alkoxy, $C_1$—$C_5$-carbonyl, carbonyl-$C_1$—$C^6$-alkyl radicals can be saturated or unsaturated, branched or unbranched and can be monosubstituted or polysubstituted by a radical $R^{73}$, where $R^{73}$ has the meanings already mentioned and two of each of the radicals $R^{73}$ can be linked in pairs via a bridge $[—CR^{74}R^{75}—]_m$ where m is 2, 3 or 4 and $R^{74}$ and $R^{75}$ have the meanings already mentioned and one or more non-adjacent groups $[—CR^{74}R^{75}—]$ can be replaced by oxygen or an imino radical optionally substituted by $C_1$—$C_5$-alkyl.

Examples of compounds which can be used as mediators are 2,6-dihydroxy-3-nitrosopyridine, 2,3-dihydroxy-4-nitrosopyridine, 27 6-dihydroxy-3-nitrosopyridine-4-carboxylic acid, 2,4-dihydroxy-3-nitroso-pyridine, 3-hydroxy-2-inercaptopyridine, 2-hydroxy-3-mercaptopyridine, 2,6-diamino-3-nitrosopyridine, 2,6-diamino-3-nitrosopyridine-4-carboxylic acid, 2-hydroxy-3-nitrosopyridine, 3-hydroxy-2-nitrosopyridine, 2-mercapto-3-nitrosopyridine, 3-mercapto-2-nitrosopyridine, 2-amino-3-nitrosopyridine, 3-amino-2-nitrosopyridine, 2,4-dihydroxy-3-nitrosoquinoline, 8-hydroxy-5-nitrosoquinoline, 2,3-dihydroxy-4-nitrosoquinoline, 3-hydroxy-4-nitrosoisoquinoline, 4-hydroxy-3-nitrosoisoquinoline, 8-hydroxy-5-nitrosoisoquinoline and tautomers of these compounds.

As mediators, preference is given to 2,6-dihydroxy-3-nitrosopyridine, 2,6-diamino-3-nitrosopyridine, 2,6-dihydroxy-3-nitrosopyridine-4-carboxylic acid, 2,4-dihydroxy-3-nitrosopyridine, 2-hydroxy-3-mercaptopyridine, 2-mercapto-3-pyridinol, 2,4-dihydroxy-3-nitrosoquinoline, 8-hydroxy-5-nitrosoquinoline, 2,3-dihydroxy-4-nitrosoquinoline and tautomers of these compounds.

The mediator can in addition be selected from the group consisting of stable nitroxyl free radicals (nitroxides), that is these free radicals can be obtained, characterized and kept in pure form.

Preferably, as mediators, use is made in this case of compounds of the general formulae (XXXI), (XXXII) or (XXXIII)

(XXXI)

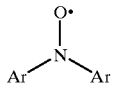

-continued (XXXII)

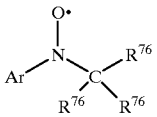

(XXXIII)

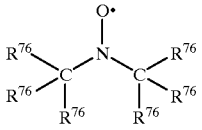

where Ar is a monovalent homoaromatic or heteroaromatic monocyclic or bicyclic radical and where this aromatic radical can be substituted by one or more identical or different radicals $R^{77}$ selected from the group consisting of halogen, formyl, cyano, carbamoyl, carboxyl, ester or salt of the carboxyl radical, sulfono radical, ester or salt of the sulfono radical, sulfamoyl, nitro, nitroso, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phospho, phosphono, phosphonooxy radical, ester or salt of the phosphonooxy radical and where phenyl, carbamoyl and sulfamnoyl radicals can be unsubstituted or monosubstituted or polysubstituted by a radical $R^{78}$, the amnino radical can be -monosubstituted or disubstituted with $R^{78}$ and the aryl-$C_1$—$_5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{78}$, where $R^{78}$ can be present singly or multiply and is identical or different and is hydroxyl, formyl, cyano, carboxyl radical, ester or salt of the carboxyl radical, carbainoyl, sulfono, sulfamnoyl, nitro, nitroso, amino, phenyl, $C_1$—$C_5$-alkyl, $C_1$—$C_5$-alkoxy, $C_1$—$C_5$-alkylcarbonyl radical and $R^{76}$ is identical or different and is halogen, hydroxyl, mercapto, formyl, cyano, carbamoyl, carboxyl radical, ester or salt of the carboxyl radical, sulfono radical, ester or salt of the sulfono radical, sulfamoyl, nitro, nitroso, amino, phenyl, aryl-$C_1$—$C_5$-alkyl, $C_1$—$C_{12}$-alkyl, $C_1$—$C_5$-alkoxy, $C_1$—$C^{10}$-carbonyl, carbonyl-$C_1$—$C_6$-alkyl, phospho, phosphono, phosphonooxy radical, ester or salt of the phosphonooxy radical and $R^{76}$, in the case of bicyclic stable nitroxyl free radicals (structure XXXIII), can also be hydrogen and where carbamoyl, sulfamoyl, amino, -mercapto and phenyl radicals can be unsubstituLed or monosubstituted or polysubstituted by a radical $R^{79}$ and the aryl-$C_1$—$C_5$-alkyl, $C_1$—$C^{12}$-alkyl, $C_1$—$C^5$-alkoxy, $C^1$—$C^{10}$-carbonyl, carbonyl-$C_1$—$C^6$-alkyl radicals can be saturated or unsaturated, branched or unbranched and can be monosubstituted or polysubstituted by a radical $R^{79}$, where $R^{79}$ is identical or different and is hydroxyl, formyl, cyano, carboxyl radical, ester or salt of the carboxyl radical, carbamoyl, sulfono, sulfamoyl, nitro, nitroso, amino,. phenyl, $C_1$—$C_5$-alkyl, $C_1$—$C^5$-alkoxy radical, $C_1$—$C_5$-alkylcarbonyl radical and two of each of the radicals $R^{78}$ or $R^{79}$ can be linked in pairs via a bridge $[—CR^{80}R^{81}—]_m$ where m is 0, 1, 2, 3 or 4 and $R^{80}$ and $R^{81}$ are identical or different and are halogen, carboxyl radical, ester or salt of the carboxyl radical, carbamoyl, sulfamoyl, phenyl, benzoyl, $C_1$—$C^5$-alkyl, $C_1$—$C_5$-alkoxy radical, $C_1$—$C_5$-alkylcarbonyl radical and one or more non-adjacent groups $[—CR^{80}R^{81}—]$ can be replaced by oxygen, sulfur or an imino radical optionally substituted by $C_1$—$C_5$-alkyl and two adjacent groups [—$CR^{80}R^{81}$—] can be replaced by a group [—$CR^{80}$=$CR^{81}$—], [—$CR^{80}$=N—] or [—$CR^{80}$=N(O)—].

As mediators, particular preference is given to nitroxyl free radicals of the general formulae (XXXIV) and (XXXV), (XXXIV)

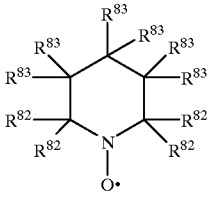

(XXXV)

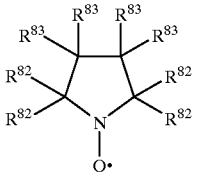

where $R^{81}$ is identical or different and is phenyl, aryl-$C_1$—$C^5$-alkyl, $C^1$—$C^{12}$-alkyl, $C_1$—$C_5$-alkoxy, $C_1$—$C^{10}$-carbonyl, carbonyl-$C^1$—$C_6$-alkyl where phenyl radicals can be unsubstituted or monosubstituted or polysubstituted by a radical $R^{84}$ and the aryl-$C_1$—$C_5$-alkyl, $C^1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{84}$, where $R^{84}$ can be present singly or multiply and is identical or different and is hydroxyl, formyl, carboxyl radical, ester or salt of the carboxyl radical, carbamoyl, sulfono, sulfamoyl, nitro, nitroso, amino, phenyl, benzoyl, $C_1$—$C_5$-alkyl, $C_1$—$C_5$-alkoxy radical, $C_1$—$C_5$-alkylcarbonyl radical and $R^{83}$ is identical or different and is hydrogen, hydroxyl, mercapto, formyl, cyano, carbamoyl, carboxyl radical, ester or salt of the carboxyl radical, sulfono radical, ester or salt of the sulfono radical, sulfamoyl, nitro, nitroso, amino, phenyl, aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl, phospho, phosphono, phosphonooxy radical, ester or salt of the phosphonooxy radical where carbamoyl, sulfamoyl, amino, mercapto and phenyl radicals can be unsubstituted or monosubstituted or polysubstituted by a radical $R^{78}$ and the aryl-$C_1$—$C_5$-alkyl, $C_1$—$C_{12}$-alkyl, $C_1$—$C_5$-alkoxy, $C_1$—$C_{10}$-carbonyl, carbonyl-$C_1$—$C_6$-alkyl radicals can be saturated or unsaturated, branched or unbranched and can be monosubstituted or polysubstituted by a radical $R^{78}$ and a [—$CR^{83}R^{83}$—] group can be replaced by oxygen, an imino radical optionally substituted by $C_1$—$C_5$-alkyl, a (hydroxy) imino radical, a carbonyl function or a vinylidene function optionally monosubstituted or disubstituted by $R^{78}$ and two adjacent groups [—$CR^{83}R^{83}$—] can be replaced by a group [—$CR^{83}$=$CR^{83}$—] or [—$CR^{83}$=N—] or [—$CR^{83}$=N(O)—].

Examples of compounds which can be used as mediators are 2,2, 6, 6-tetramethylpiperidin-1-oxyl (TEMPO),
4-hydroxy-2, 2,61,6-tetramethylpiperidin-1-oxyl,
4-oxo-2 ,2,6, 6-tetramethylpiperidin-1-oxyl,
4-acetamido-2,2,6, 6-tetramethylpiperidin-1-oxyl,
4-(ethoxyf luorophosphinyloxy) -2,2, 6, 6-tetramethylpiperidin-1-oxyl,
4-(isothiocyanato) -2,2,6,6-tetramnethylpiperidin-1-oxyl,
4-maleimuido-2,2,6,6-tetramnethylpiperidin-1-oxyl,
4-(4-nitrobenzoyloxy) -2,2,6,6-tetrainethylpiperidin-1-oxyl,
4-(phosphonooxy) -2,2,6,6-tetramethylpiperidin-1-oxyl,
4-cyano-2,2,6,6-tetramethylpiperidin-1-oxyl,
3-carbamnoyl-2,2,5,5-tetramethyl-3-pyrrolin-1-oxyl,
4-phenyl-2,2,5,5-tetramethy-3-imidazolin-1-oxyl 3-oxide,
4-carbamoyl-2,2,5,5-tetramethyl-3-imidazolin-1-oxyl 3-oxide,
4-phenacylidene-2,2,5,5-tetramethylimidazolin-1-oxyl,
3-(aminomethyl)-2,2,5,5-tetramethylpyrrolidin-N-oxyl,
3-carbamoyl-2,2,5,5-tetramethylpyrrolidin-N-oxyl,
3-carboxy-2,2,5,5-tetramethylpyrrolidin-N-oxyl,
3-cyano-2,2,5,5-tetramethylpyrrolidin-N-oxyl,
3-maleimido-2,2,5,5-tetramethylpyrrolidin-N-oxyl,
3-(4-nitrophenoxycarbonyl)-2,2,5,5-tetramethylpyrrolidin-N-oxyl.

As mediators, preference is given to
2,2,6,6-tetramethylpiperidin-1-oxyl (TEMPO),
4-hydroxy-2,2,6,6-tetramethylpiperidin-1-oxyl,
4-oxo-2,2,6,6-tetramethylpiperidin-1-oxyl,
4-acetamido-2,2,6,6-tetramethylpiperidin-1-oxyl,
4-(isothiocyanato)-2,2,6,6-tetramethylpiperidin-1-oxyl,
4-maleimido-2,2,6,6-tetramethylpiperidin-1-oxyl,
4-(4-nitrobenzoyloxy)-2,2,6,6-tetramethylpiperidin-1-oxyl,
4-(phosphonooxy)-2,2,6,6-tetramethylpiperidin-1-oxyl,
4-cyano-2,2,6,6-tetramethylpiperidin-1-oxyl,
3-carbamoyl-2,2,5,5-tetramethyl-3-pyrrolin-1-oxyl,
4-phenyl-2,2,5,5-tetramethyl-3-imidazolin-1-oxyl 3-oxide,
4-carbamoyl-2,2,5,5-tetramethyl-3-imidazolin-1-oxyl 3-oxide,
4-phenacylidene-2,2,5,5-tetramethylimidazolidin-1-oxyl.

As mediators, in particular preference is given to 2,2,6,6-tetramethylpiperidin-1-oxyl (TEMPO), and 4-hydroxy-2,2,6,6-tetramethylpiperidin-1-oxyl.

Particularly preferred mediators are N-hydroxyphthalimide, 1-hydroxy-1H-benzotriazole, violuric acid, N-hydroxyacetanilide and derivatives thereof listed above.

Very particular preference is given to 3-amino-N-hydroxyphthalimide, 4-amino-N-hydroxy-phthalimide, N-hydroxyphthalimide, 3-hydroxy-N-hydroxy-phthalimide, 3-methoxy-N-hydroxyphthalimide, 3,4-dimethoxy-N-hydroxyphthalimide, 4,5-dimethoxy-N-hydroxyphthalimide, 3,6-dihydroxy-N-hydroxyphthalimide, 3,6-dimethoxy-N-hydroxyphthalimide, 3-methyl-N-hydroxy-phthalimide, 4-methyl-N-hydroxyphthalimide, 3,4-dimethyl-N-hydroxyphthalimide, 3,5-dimethyl-N-hydroxyphthalimide, 3,6-dimethyl-N-hydroxyphthalimide, 3-isopropyl-6-methyl-N-hydroxyphthalimide, 3-nitro-N-hydroxyphthalimide, 4-nitro-N-hydroxyphthalimide, 1-hydroxy-1H-benzotriazole, violuric acid and N-hydroxyacetanilide.

For the process according to the invention, extraordinary preference is given to the mediator selected from the group consisting of the compounds 1-nethylvioluric acid, 1,3-dimethylvioluric acid, thio-violuric acid, alloxan 4,5-dioxime and alloxan-5-oxime hydrate (violuric acid).

The mediator molecule, after activation at the electrode, reaches the lignin by thermal diffusion. This process can be reinforced by intermixing, e.g. stirring, or other processes, e.g. electrophoresis.

The system according to the invention can additionally comprise other auxiliaries, e.g. oxidants, which reinforce the delignification of the lignin-containing material.

The invention further relates to processes for the electrochemical cleavage of compounds, which comprises carrying out the cleavage of the compound to be cleaved by electrochemical activation by means of electrodes of at least one mediator which comprises no metals or heavy metals.

The compound to be cleaved is, in the process according to the invention, preferably taken to mean the delignification of lignin-containing materials. However, it is equally possible to cleave other compounds, such as dyes. Thus, for example, the bleaching of textiles is also possible by means of the process according to the invention.

Particular preference is given in this case to applying the process to indigo-dyed denim and to products which are fabricated therefrom.

The process according to the invention can advantageously be employed at temperatures of about 20° C. to 100° C. Preferably, it is carried out at a temperature of 40 to 100° C., particularly preferably at 70–90° C. Preferably, the process is carried out at a voltage of 0.5–40 V, particularly preferably 1V to 5V, using direct current d.c.

The mediator is preferably used in amounts of 1 kg to 100 kg/metric t of pulp, particularly preferably 2 kg to 50 kg/metric t of pulp. Preferably, the pH when the process is carried out is below 7.

Preferably, in the process according to the invention, electrolysis of water additionally takes place which serves for the oxygen saturation of the reaction batch.

The process according to the invention has the following advantages in comparison with known processes:

1. Costs of an enzyme do not arise.

2. The delignification can be carried out at atmospheric pressure at temperatures in the vicinity of the boiling point of water. No account needs to be taken of the sharp temperature optimum of an enzyme. This eliminates costs of cooling the pulp.

3. The process is not dependent on the oxygen partial pressure, since oxygen can also be produced in the solution where the active species of the mediator is produced. The process can thus be carried out in systems which are under atmospheric pressure (tanks) or else under elevated pressure (hydrostatic pressure in "digesters"). Measures for introducing oxygen under pressure are not necessary.

4. A relatively large range of variations in the selection of the mediators is possible, since the additional property of substrate recognition by an enzyme, e.g. laccase, do not need to be complied with.

5. The narrow pH optimum of an enzyme requires that the pH is set relatively precisely by titration and is kept constant within narrow limits during the process. The electrochemical system for mediator regeneration is less sensitive to fluctuations in pH.

6. No metal/heavy-metal-containing mediators are used which are discharged in the wastewater or need to be removed.

7. No chlorine-containing compounds are used, so that absolutely no chlorine pollution of the environment is associated with the process.

The degradation of lignin in the delignification of pulp is quantified by determining what is termed the kappa number. The kappa number is a measure of the lignin content of a chemical pulp. A decrease in the kappa number denotes a reduction in the lignin content of the material. The kappa number can be determined by, for example, methods known from the literature, e.g. as specified in DIN 543357.

DETAILED DESCRIPTION OF PREFERRED EMBODIMENTS

Other objects and features of the present invention will become apparent from the following detailed description considered in connection with the accompanying examples. It should be understood, however, that this is designed for the purpose of illustration only and not as a definition of the limits of the invention.

The following process steps were used equally in all examples:

Pulp preparation (washing)

Approximately 30 g of pulp were weighed into an 800 ml glass beaker and sufficient distilled water was added to cover the pulp well and provide a water supernatant of approximately 1 cm. This batch was agitated for 30 min at 50° C. on a heated agitator, with occasional stirring with a glass rod or stainless steel spoon. The disintegrated pulp was then transferred to a filter cushion (nylon, 30 $\mu$m mesh width) and washed under flowing water until the washing water is colorless; for this purpose, the water remaining in the chemical pulp after the washing procedure was mechanically removed as far as possible by pressing.

The prewashed pulp w as again washed with twice-distilled water in the 800 ml glass beaker and expressed. The vessel was sealed with parafilm and the washed pulp was kept in it until use.

Mediator-reinforced electro chemical b leaching of pulp

The electrochemical delignification of softwood pulp using th e various mediators was carried out in a reaction without a diaphragm. The batch was mixed during the electrolysis using a stirrer bar. The pulp was suspended in 0.1 M acetate buffer, pH 4.5, unless stated otherwise. The concentratIon of the mediator, the type of the electrodes, the reaction temperature and other technical parameters are specified under the individual experiments.

In the comparison examples, an enzymatic process was used for delignification of pulp.

Mediator-reinforced enzymatic bleaching of pulp 5 g of "moist" washed pulp were weighed into a 50 ml Erlenmeyer flask.

23.25 ml of twice-distilled water were placed into a second 50 ml Erlenmeyer flask and 750 $\mu$l of a 1 M mediator solution in 1 M NaOH were pipetted into this. 5 ml of enzyme solution (1 mg of laccase/ml of twice-distilled water; specific activity 10 U/mg) were subsequently pipetted into this. Immediately after their addition, the pH was adjusted to the desired value of pH 4.5 using a pH meter.

The pulp which was weighed in advance from the first flask was added, well mixed (shaking/agitation) with the liquid portion and the pH value was monitored. The batch was sealed with parafilm and incubated under atmospheric pressure at 45° C. in a water bath.

The batch was tipped into a vacuum filter, the liquid was filtered off with suction and the batch was washed approximately 6 times with twice-distilled water, with occasional stirring, until the filtrate was no longer colored. This pulp is used for the kappa determination.

Kappa number determination

The washed, still-moist pulp is halved. One half is extracted and then used for the kappa determination (DIN 64357); the kappa number of the other half is determined without extraction.

Extraction 100 ml of 40 mM NaOH and a stirrer bar were added to the washed pulp. The extraction mixture was agitated vigorously for 65 min at 60° C. The extracted pulp was subsequently washed with twice-distilled water on a vacuum filter as above until the filtrate was neutral (pH meter). The kappa number was then determined.

EXAMPLE 1

Enhancing the reduction in kappa number by electrochemical activation of violuric acid In a vessel without a diaphragm containing two electrodes of stainless steel 1.4571 (as specified in DIN 17850), oxygen-delignified softwood pulp having a solids content of 7.5% was treated in 0.1 M acetate buffer pH 4.5 and a dose rate of violuric acid of 35 kg/metric ton of pulp for 4 h at atmospheric pressure at 90° C. with stirring by a magnetic stirrer. In the one experiment, a voltage of 5 V was applied to the electrodes. The kappa number of the pulp used after alkaline extraction, but without treatment with violuric acid, was 16.97. The kappa number was subsequently determined as described above. The extent of delignification may be calculated therefrom.

A certain reduction in kappa number is also achieved by treatment with violuric acid alone. The improvement in delignification is calculated as a factor which specifies how many times higher delignification with electrochemical activation of violuric acid is than without electromchemical activation.

The results are summarized in Table 1.

TABLE 1

| | Enhancement of the reduction in kappa number by electrochemical activation of violuric acid | | |
|---|---|---|---|
| | Kappa number | Delignification | Factor |
| without electricity | 13.15 | 22.5% | 1 |
| with electricity | 4.11 | 75.8% | 3.37 |

EXAMPLE 2

Dependence of the reduction in kappa number on the concentration of violuric acid In a vessel without a diaphragm containing two electrodes of stainless steel 1.4571 (as specified in DIN 17850), oxygen-delignified softwood pulp having a solids content of 7.5% was treated in 0.1 M acetate buffer pH 4.5 and a dosage rate of violuric acid of 0–70 kg/metric ton of pulp for 4 h at atmospheric pressure at 21° C. (room temperature) with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of delignification may be calculated from this.

Applying a voltage causes a current to flow which leads to t breakdown of water. As a result of this treatment without violuric acid, a certain reduction in kappa number also is achieved. The enhancement in delignification is calculated as a factor which specifies how many times higher the delignification with added violuric acid is than without.

The results are summarized in Table 2.

TABLE 2

| Reduction in kappa number as a function of the concentration of violuric acid | | | |
|---|---|---|---|
| Violuric acid [kg/metric t] | Kappa number | Delignification | Factor |
| 0.00 | 14.51 | 14.5% | 1 |
| 2.06 | 14.03 | 17.32% | 1.19 |
| 4.13 | 12.7 | 25.2% | 1.74 |
| 8.25 | 8.92 | 47.4% | 3.27 |
| 17.5 | 7.15 | 57.9% | 3.99 |
| 35.00 | 6.92 | 59.2% | 4.09 |
| 70.00 | 5.21 | 69.3% | 4.78 |

EXAMPLE 3

Reduction in kappa number as a function of the electrolysis time

In a vessel without a diaphragm containing two electrodes of stainless steel 1.4571 (as specified in DIN 17850), oxygen-delignified soft wood pulp having a solids content of 7.5% was treated in 0.1 M acetate buffer pH 4.5 and a dosage rate of violuric acid of 35 kg/metric ton of pulp for 0–24 h at atmospheric pressure at 21° C. (room temperature) with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of delignification may be calculated from this.

The efficiency of the system over the time is characterized by the reduction in kappa number achieved divided by the electrolysis time. This value is entered in the right column of Table 3.

The results are summarized in Table 3.

TABLE 3

| Reduction in kappa number as a function of electrolysis time | | | |
|---|---|---|---|
| Electrolysis time [h] | Kappa number | Delignification | Delignification per unit time |
| 0.00 | 16.97 | 0.0% | — |
| 0.25 | 10.28 | 39.4% | 1.58 |
| 0.5 | 8.94 | 47.3% | 0.95 |
| 1.00 | 7.81 | 54.0% | 0.54 |
| 2.00 | 7.53 | 55.6% | 0.28 |
| 3.00 | 6.47 | 61.9% | 0.21 |
| 4.00 | 6.43 | 62.1% | 0.16 |
| 24.00 | 4.69 | 72.4% | 0.03 |

EXAMPLE 4

Reduction in kappa number as a function of reaction temperature

In a vessel without a diaphragm containing two electrodes of stainless steel 1.4571 (as specified in DIN 17850), oxygen-delignified softwood pulp having a solids content of 7.5% was treated in 0.1 M acetate buffer pH 4.5 and a dosage rate of violuric acid of 35 kg/metric ton of pulp for 4 h at atmospheric pressure at temperatures of 21° C. (room temperature) to 90° C. with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of delignification may be calculated from this.

The reduction in kappa number achieved in the system is virtually constant over a wide temperature range from 45° C. to 90° C. The mean delignification was calculated for this range (45° C. to 90° C.) and the delignification at each temperature was calculated from this mean. This value was termed temperature tolerance and is entered in the right column of Table 4.

The results are summarized in Table 4.

TABLE 4

Reduction in kappa number as a function of the reaction temperature

| Temperature [° C.] | Kappa number | Delignification | Temperature tolerance |
|---|---|---|---|
| 21° C. | 6.43 | 62.1% | −12.1% |
| 45° C. | 4.47 | 73.7% | −0.5% |
| 60° C. | 4.21 | 75.2% | +1.0% |
| 70° C. | 4.4 | 74.1% | −0.1% |
| 80° C. | 4.73 | 72.1% | −2.0% |
| 90° C. | 4.11 | 75.8% | +1.6% |

EXAMPLE 5

Reduction in kappa number as a function of the pH of the reaction batch

In a vessel without a diaphragm containing two electrodes of stainless steel 1.4571 (as specified in DIN 17850), oxygen-delignified softwood pulp having a solids content of 7.5% was treated in 0.1 M buffer of pH 4.5 to pH 11 and at a dosage rate of the mediator of 35 kg/metric ton of pulp for 4 h at atmospheric pressure at 90° C. with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of delignification may be calculated from this.

The results are summarized in Table 5.

TABLE 5

Reduction in kappa number as a function of the pH of the reaction batch

| pH | Kappa number | Delignification |
|---|---|---|
| 4.5 | 4.11 | 75.8% |
| 7 | 8.97 | 47.1% |
| 11.00 | 11.58 | 31.8% |

EXAMPLE 6

Comparison of the reduction in kappa number achieved by various mediators

In a vessel without a diaphragm containing two electrodes of stainless steel 1.4571 (as specified in DIN 17850), oxygen-delignified softwood pulp having a solids content of 7.5% was treated in 0.1 M acetate buffer pH 4.5 and a dosage rate of the mediator of 35 kg/metric ton of pulp for 4 h at atmospheric pressure at 21° C. (room temperature) with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of the delignification may be calculated from this.

The results are summarized in Table 6.

TABLE 6

Delignification as a function of the type of mediator

| Mediator | Kappa number | Delignification (%) |
|---|---|---|
| 1-hydroxybenzotriazole | 13.87 | 18.3 |
| 1-hydroxybenzotriazole-3-sulfonic acid | 13.15 | 22.5 |
| N-hydroxyphthalimide | 13.15 | 22.5 |
| 3-amino-N-hydroxyphthalimide | 12.76 | 24.8 |
| N-phenyl-N-hydroxyacetamide | 13.25 | 21.9 |
| N-phenyl-N-hydroxyformamide | 13.58 | 20 |
| Violuric acid | 6.92 | 59.2 |
| N,N'-dimethylvioluric acid | 7.46 | 56 |
| 2,2,6,6-tetramethylpiperidine-N-oxy | 12.28 | 27.6 |
| 4-oxo-2,2,6,6-tetramethyl-piperidine-N-oxy | 13.1 | 22.8 |
| N-methyl-N-hydroxybenzamide | 12.75 | 24.9 |
| N-t-butyl-N-hydroxyacetamide | 11.73 | 30.9 |
| 1-nitroso-2-naphthol | 14.15 | 16.6 |
| 1-nitroso-2-naphthol-3,6-disulfonic acid disodium salt | 13.86 | 18.3 |
| 3-nitroso-2,4-dihydroxyquinoline | 13.38 | 21.2 |
| 3-nitroso-2,4-dihydroxypyridine | 12.83 | 24.4 |

EXAMPLE 7

Reduction in kappa number as a function of the buffer concentration

In a vessel without a diaphragm containing two electrodes of stainless steel 1.4571 (as specified in DIN 17850), oxygen-delignified softwood pulp having a solids content of 5% was treated in 0.1 M acetate buffer pH 4.5 or 0.025 M acetate buffer pH 4.5 or only in water and at a dosage rate of violuric acid of 35 kg/metric ton of pulp for 4 h at atmospheric pressure at 90° C. with stirring by a magnetic stirrer. In the experiment, a voltage of 5 V was applied to the electrodes. The kappa number of the pulp used after alkaline extraction, but without treatment with violuric acid, was 16.97. The kappa number was subsequently determined as described above. The extent of delignification may be calculated from this.

The batch without buffer salt was titrated to pH 4.5 after adding the pulp to the violuric acid solution using sodium hydroxide solution or sulfuric acid. No active stabilization of the pH was performed. The pH altered only slightly during the reaction.

The results are summarized in Table 7.

TABLE 7

Reduction in kappa number as a function of buffer concentration

| Buffer concentration | Kappa number | Delignification |
|---|---|---|
| 100 mM | 3.56 | 79% |
| 25 mM | 2.79 | 84% |
| 0 mM | 3.09 | 82% |

Softwood pulp; 5% solids content; reaction time 4 h; Temperature 90° C.; dosaqe rate 35 kg/metric t of violuric acid This example shows that the delignification is not dependent on the buffer concentration and that a comparable delignification proceeds even in a buffer-free system of pH 4.5.

EXAMPLE 8

Bleaching of jeans material with violuric acid

In a vessel without a diaphragm containing two electrodes of stainless steel 1.4571 (as specified in DIN 17850), dyed jeans material (9 g/160 $cm^2$) was treated in 0.1 M acetate buffer pH 4.5 and at a dosage rate of violuric acid of 35 g/kg of material at atmospheric pressure for defined times at 900° C. with stirring by a magnetic stirrer. In the experiment, a voltage of 5 V was applied to the electrodes. After the treatment, the material pieces were washed under flowing water until the wash water was no longer colored. The material pieces were dried in a sheet drier and then pressed and assessed optically by a suitable spectrophotometer. The experimental evaluation was performed as follows: the degree of bleaching and the color were determined using a Minolta CM 3700d spectrophotometer suitable for the colorimetric evaluation of reflecting objects in accordance with the manufacturer's instructions. Measurements were made without luster and without UV. The brightnesses L* of the samples were determined as percentages of the total reflectance in comparison with a white standard (R 457) (white=100; black=0). The standard illuminant used was C/2°. The software PP2000 from opticontrol was used for the evaluation.

The values of the material sample electro-chemically treated with violuric acid were compared with the values of a material sample electrochemically treated in each case without violuric acid for the same period of time. Table 8 shows the relative change in brightness L* of material samples treated for different times with violuric acid.

TABLE 8

Increase in the brightness of dyed jeans material due to treatment with electrochemically activated violuric acid as a function of time.

| Treatment time (min) | L* |
|---|---|
| 0 | 2.73 |
| 15 | 26.24 |
| 30 | 46.31 |
| 60 | 57.28 |
| 120 | 62.31 |
| 240 | 65.42 |
| 480 | 67.02 |

Under given mediator concentrations, the brightness of the material samples can be incrased by a defined extent by choosing an appropriate time of action.

Comparison example 1: Comparison of the electrochemical activation of violuric acid with enzymatic activation by laccase from Trametes versicolor.

The electrochemical reaction of softwood pulp with violuric acid and with electrochemically activated violuric acid is carried out as in Example 1. In addition, a batch containing laccase at a high dose (50 IU/3 g of pulp) was additionally carried out for the enzymatic activation of the violuric acid.

After determinatin of the kappa number, the delignification was calculated. Measured relative to the treament with violuric acid alone, the enzymatic activation, despite the high enzyme dose, produces a substantially lower acceleration of delignification than the electrochemical activation of violuric acid.

The results are summarized in Table 9.

TABLE 9

Comparison of electrochemical activation of violuric acid with enzymatic activation by laccase from Trametes versicolor

| | Kappa number | Delignification [%] | Factor |
|---|---|---|---|
| Violuric acid | 13.15 | 22.5 | 1 |
| Violuric acid (laccase activated) | 9.05 | 46.7 | 2.07 |
| Violuric acid (electrically activated) | 4.11 | 75.8 | 3.37 |

Comparison example 2: Reduction in kappa number in the enzymatic activation of violuric acid by laccase from Trametes versicolor as a function of temperature Oxygen-delignified softwood pulp was treated for 4 h at 45° C. and 90° C. each time with 50 U of laccase from Trametes versicolor with stirring by a magnetic stirrer. The kappa number was then determined and the delignification was calculated from this.

The results are summarized in Table 10.

TABLE 10

Delignification in enzymatic activation of violuric acid by laccase from Trametes versicolor as a function of temperature.

| Temperature [° C.] | Kappa number | Delignification [%] | Factor |
|---|---|---|---|
| 45 | 5.58 | 67.1 | 1 |
| 90 | 9.05 | 46.7 | 0.7 |

The reduction in kappa number achieved becomes less with increase in temperature. The laccase temperature optimum is around 45° C. An increase in temperature leads to a worsening of the result, since the enzyme is used outside its temperature optimum and is more rapidly inactivated at the elevated temperature.

While several embodiments of the present invention have been shown and described, it is to be understood that many changes and modifications may be made thereunto without departing from the spirit and scope of the invention as defined in the appended claims.

What is claimed is:

1. A system for the electrochemical cleavage of compounds comprising:

an aqueous liquid containing a mediator which is devoid of a substance selected from the group consisting of a metal, chlorine, and a heavy metal and at least two electrodes for the electrochemical activation of the mediator, and a compound to be cleaved by said electrochemical activation of the mediator.

2. The system as claimed in claim 1, wherein the electrodes consist of material selected from the group consisting of a noble metal, steel, stainless steel and carbon.

3. The system as claimed in claim 2, wherein the electrode is a stainless steel of group 1.4xxx as specified in DIN 17850.

4. The system as claimed in claim 1, wherein the mediator is selected from the group consisting of an aliphatic, cycloaliphatic, heterocyclic or aromatic NO—, NOH— and

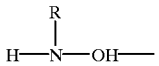

containing compound.

5. The system as claimed in claim 4, wherein the mediator is selected from the group consisting of 1-methylvioluric acid, 1,3-dimethylvioluric acid, thiovioluric acid, alloxan 4,5-dioxime and alloxan 5-oxime hydrate.

6. A process for the electrochemical cleavage of compounds, comprising providing an aqueous liquid containing a compound to be cleaved, and at least one mediator which is devoid of a substance selected from the group consisting of a metal, chlorine, and a heavy metal;

immersing an anode and a cathode in said liquid;

and applying a d.c. voltage to said anode and cathode, so that said compound is cleaved by electrochemical activation of said mediator.

7. The process as claimed in claim 6, wherein said mediator has a concentration less than 50 kg per metric ton of compound to be cleaved; and said aqueous liquid is at a temperature of about the boiling point of water of 100° C.

8. The process as claimed in claim 7, comprising electrolysis of water, which provides for oxygen saturation of a reaction batch, taking place in addition to the electrochemical activation of the mediator.

9. The process as claimed in claim 7, wherein said d.c. voltage is from 0.5 V to 40 V.

10. The process as claimed in claim 9, wherein said d.c. voltage is from 1 V to 5 V.

11. The process as claimed in claim 6, wherein the compound to be cleaved is selected from the group consisting of a lignin-containing compound and a dye.

12. A system for the electrochemical cleavage of compounds comprising a liquid containing a mediator which is devoid of a substance selected from the group consisting of a metal and a heavy metal;

at least two electrodes for the electrochemical activation of the mediator;

a compound to be cleaved by said electrochemical activation of the mediator; and wherein the mediator is selected from the group consisting of 1-methylvioluric acid, 1,3-dimethylvioluric acid, thiovioluric acid, alloxan 4,5-dioxime and alloxan 5-oxime hydrate.

13. The system of claim 12, wherein the liquid is an aqueous liquid.

14. A process for the electrochemical cleavage of compounds, comprising providing a liquid containing a compound to be cleaved, and at least one mediator which is devoid of a substance selected from the group consisting of a metal and a heavy metal;

immersing an anode and a cathode is said liquid;

applying a d.c. voltage to said anode and cathode, so that said compound is cleaved by electrochemical activation of said mediator;

wherein the mediator is selected from the group consisting of 1-methylvioluric acid, 1,3-dimethylvioluric acid, thiovioluric acid, alloxan 4,5-dioxime and alloxan 5-oxime hydrate.

15. The process of claim 14, wherein the liquid is an aqueous liquid.

* * * * *